US006863620B2

(12) United States Patent
Tucker, Sr.

(10) Patent No.: US 6,863,620 B2
(45) Date of Patent: Mar. 8, 2005

(54) GOLF CLUB HAVING REPLACEABLE STRIKING SURFACE ATTACHMENTS AND METHOD FOR REPLACING SAME

(75) Inventor: Richard B. C. Tucker, Sr., Ruxton, MD (US)

(73) Assignee: STX, LLC, Baltimore, MD (US)

( * ) Notice: Subject to any disclaimer, the term of this patent is extended or adjusted under 35 U.S.C. 154(b) by 200 days.

(21) Appl. No.: 09/758,152

(22) Filed: Jan. 12, 2001

(65) Prior Publication Data

US 2002/0022532 A1 Feb. 21, 2002

Related U.S. Application Data

(60) Provisional application No. 60/176,008, filed on Jan. 14, 2000.

(51) Int. Cl.[7] ..... A63B 53/04

(52) U.S. Cl. ..... 473/288; 473/329; 473/325

(58) Field of Search ..... 473/288, 325, 473/340, 342, 345, 349, 214, 329, 335, 348, 350, 291, 339, 334; 29/460, 508, 530, 527.2, 447, 525.01

(56) References Cited

U.S. PATENT DOCUMENTS

| | | | | |
|---|---|---|---|---|
| 3,310,309 A | * | 3/1967 | Moss | 473/245 |
| 3,937,474 A | | 2/1976 | Jepson et al. | |
| 4,121,832 A | | 10/1978 | Ebbing | |
| 4,422,638 A | | 12/1983 | Tucker | |
| 5,332,214 A | | 7/1994 | Tucker, Sr. | |
| 5,332,223 A | | 7/1994 | Johnson | |
| 5,346,213 A | | 9/1994 | Yamada | |
| 5,437,447 A | | 8/1995 | Rigutto | |
| 5,458,332 A | | 10/1995 | Fisher | |
| 5,531,439 A | | 7/1996 | Azzarella | |
| 5,542,675 A | | 8/1996 | Micciche et al. | |
| 5,620,381 A | | 4/1997 | Spalding | |
| 5,674,132 A | | 10/1997 | Fisher | |
| 5,688,190 A | | 11/1997 | Rowland et al. | |
| 5,690,561 A | | 11/1997 | Rowland et al. | |
| 5,690,562 A | | 11/1997 | Sturm | |
| 5,718,644 A | | 2/1998 | Donofrio | |
| 5,746,664 A | | 5/1998 | Reynolds, Jr. | |
| 5,839,974 A | | 11/1998 | McAllister | |
| 5,921,871 A | | 7/1999 | Fisher | |
| 5,997,411 A | | 12/1999 | Holub | |
| 6,001,024 A | | 12/1999 | Van Alen, II et al. | |
| 6,001,030 A | | 12/1999 | Delaney | |
| 6,102,813 A | * | 8/2000 | Dill | 473/305 |
| 6,224,496 B1 | | 5/2001 | Rowland et al. | |
| 6,238,303 B1 | * | 5/2001 | Fite | 473/342 |
| 6,270,423 B1 | | 8/2001 | Webb | |
| 6,533,678 B1 | | 3/2003 | Johnson | |

* cited by examiner

*Primary Examiner*—Glenn Caldarola
*Assistant Examiner*—Tom Duong
(74) *Attorney, Agent, or Firm*—Shaw Pittman LLP

(57) ABSTRACT

An adjustable customized golf club, e.g., a golf putter, as well as a method for using the club, wherein the club has a head, a striking surface attachment, and one or more lock fittings that positively lock the striking surface attachment to the head. The striking surface attachment is one of several selectable attachments, each with different performance characteristics, e.g., rebound. The one or more lock fittings positively lock the striking surface attachments to the putter head such that the club components are firmly fixed, yet are still quickly removable and replaceable. In a representative embodiment, the striking surface attachment can be removed by hand and without tools. A golfer quickly changes the striking surface attachments without losing the feel of the prior striking surface attachment, thereby enabling the golfer to realistically compare the differences between the attachments before selecting and playing with a particular striking surface attachment.

12 Claims, 21 Drawing Sheets

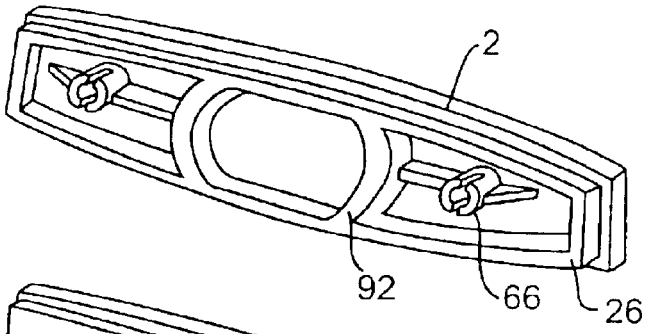
FIG. 16A
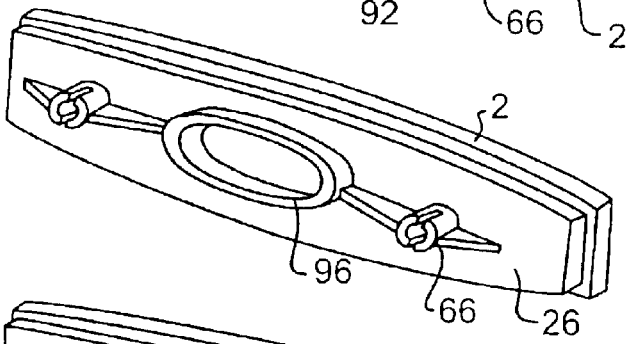
FIG. 16B
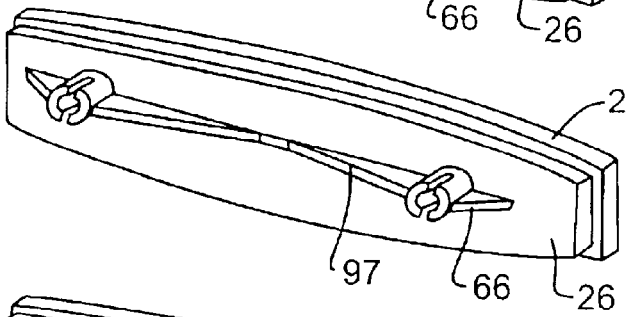
FIG. 16C
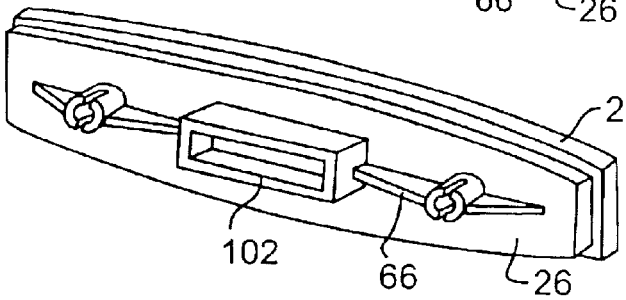
FIG. 16D
FIG. 16E
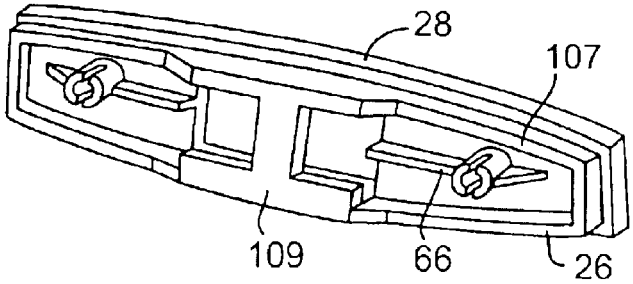
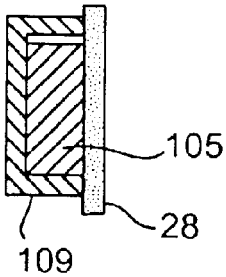
FIG. 16F

GOLF CLUB HAVING REPLACEABLE STRIKING SURFACE ATTACHMENTS AND METHOD FOR REPLACING SAME

This application claims the benefit of U.S. Provisional Application No. 60/176,008, filed Jan. 14, 2000.

BACKGROUND

Field of the Invention

The present invention relates generally to golf clubs, and more particularly, to a golf putter having positively locked striking surface attachments, and a method for replacing such striking surface attachments.

BACKGROUND OF THE INVENTION

Most golfers recognize that putting with accurate direction and distance requires a club that communicates a precise sense of touch and feel. The desire to maximize this precise touch and feel and to accurately control the direction of the ball has spawned literally hundreds of golf putter designs. Examples of these various designs include increased putter head mass to accommodate short backswings and lengthen ball travel, balanced putter head mass to improve directional accuracy, decreased putter head mass to increase accuracy, and special putter face striking surfaces that impart a heightened sense of feel and touch in controlling the rebound characteristics of the ball. This last aspect, concerning putter face striking surfaces, is the subject of the present application.

Golfers typically favor customized golf clubs that enhance, improve, or correct their particular style of play. For manufacturers, this customizing presents a significant challenge, especially when attempting to sell golf clubs to the mass market at competitive prices. With putters, manufacturers have experimented extensively with offering varieties of putter striking surfaces to accommodate personal preferences for club feel and touch. Thus far, manufacturers have offered two principal ways to purchase customized golf putters: 1) one-time customization, in which the manufacturer typically offers a full line of putters with basic designs, but with a variety of striking surfaces designed to appeal to diverse tastes; and 2) adjustable customization, in which a manufacturer typically offers a multi-component putter with a putter head that accepts a variety of interchangeable striking surface attachments, each suitable for different playing styles or playing conditions. The ultimate goal of each of these customization methods is to give the golfer a specialized feel and control that will persuade the golfer to purchase the customized putter instead of a non-customized putter.

In addition to appealing to golfers' desire for customized clubs, some putters attempt to conform to United States Golf Association (USGA) rules to be acceptable for USGA sanctioned play. For customized putters featuring varying striking surfaces or varying attachments, manufacturers desiring USGA conformance must pay particular attention to the USGA rules concerning the attachment of club components and the adjustability of clubs. Specifically, Appendix II.1.a of the USGA rules states that "all parts of the club shall be fixed so that the club is one unit, and it shall have no external attachments except as otherwise permitted by the Rules." Concerning adjustability, Appendix II.1.b.ii of the USGA rules, adopted to accommodate multi-component putters, states that all methods of adjustment require that "all adjustable parts are firmly fixed and there is no reasonable likelihood of them working loose during a round." For one-time customized putters, these rules are typically no obstacle because construction of the club is completed and fixed at the factory, i.e., the club has a fixed face. For adjustable customized putters, however, the multi-components sometimes are not firmly fixed nor positively locked and can have a tendency to work loose and/or fail to deliver the feel and performance of firmly fixed components.

Turning to examples of the two types of customized putters, U.S. Pat. No. 5,458,332 to Fisher and U.S. Pat. No. 5,531,439 to Azzarella disclose one-time customized fixed-face golf putter heads having recesses into which inserts are wedged and permanently fitted. In addition, U.S. Pat. No. 5,674,132 to Fisher also discloses an insert wedged into the recess of a golf putter head, but also adds an adhesive layer that securely holds the wedge insert within the recess. In adding this adhesive layer, U.S. Pat. No. 5,674,132 teaches that the adhesive helps to avoid the loosening of the insert by repeated contact of the insert bottom with the ground, during normal usage of the club. However, these one-time customized striking surface putters do not accommodate the desire to fine-tune his putter or to quickly change striking surfaces for varied playing conditions. In other words, if a striking surface is attached to a putter head by a wedged, permanent fit or a wedged fit with adhesive, the striking surface is not quickly removable.

To address this desire to repeatedly change striking surfaces, the adjustable customization designs incorporate multi-component putter heads with replaceable parts, e.g., striking surface inserts or striking surface attachments. Applicant's U.S. Pat. No. 5,332,214 discloses a golf putter that includes a multi-component head having an elastomeric striking surface, a support member for the elastomeric striking surface, a weight, a body member, and screws. The body member includes a recessed area extending substantially across the front of the body member, a central cavity extending through the body member for receiving the weight, and holes through the body member for receiving the screws. The support member includes holes for receiving the screws when the support member is fitted into the recessed area. The elastomeric striking surface is cast or adhesively secured to the support member, together making a striking surface insert.

Similarly, U.S. Pat. No. 4,121,832 to Ebbing, U.S. Pat. No. 5,690,562 to Sturm, U.S. Pat. No. 5,746,664 to Reynolds, Jr., U.S. Pat. No. 5,839,974 to McAllister, and U.S. Pat. No. 5,921,871 to Fisher all disclose golf putters having an insert fastened to a putter head using threaded screws. Each of these designs uses screws to firmly fix and positively secure the components of the putter head in a manner similar to that taught by applicant's U.S. Pat. No. 5,332,214 and determined by the USGA to be in conformance with its rules. Unfortunately, this use of screws complicates adjusting of the club by requiring tools and frustrates the golfer's ability to quickly fine-tune his putter or to easily adapt the club for varying playing conditions. In the end, golfers typically make a one-time adjustment after the purchase of the club and forgo attempts to customize the club before playing. Thus, if a striking surface is attached to a putter head using a screw, the striking surface is not quickly removable.

In an attempt to simplify adjustable customization, other types of removable insert golf putters teach interference fits in lieu of screws. However, in each case the fit is either poorly secured or secured so tightly that further adjustment is impossible. As an example of a poorly secured fit, U.S. Pat. No. 5,542,675 to Micciche et al. discloses an adaptor that snaps onto the putter head, providing an elastomeric striking surface for the putter head. Micciche explains that the putter head adaptor is "adapted to engage" around the putter head, but fails to disclose how the adaptor engages the putter head or how loose or rattling fits, caused by variances in manufacturing such as shrinkage and inconsistent dimensions, are avoided. U.S. Pat. No. 5,620,381 to Spalding discloses a removable putting face insert having a resilient rear wedge portion that is sized and positioned to press fit within a recess of the putter head. However, Spalding specifically teaches that the press fit arrangement is tight enough such that alteration of the club by a golfer is virtually impossible. U.S. Pat. No. 5,718,644 to Donofrio discloses a putter head that can retain an insert by frictional fit. However, Donofrio specifically contemplates that the insert is permanently attached and impossible to remove, and actually prefers the use of high strength epoxy for the permanent attachment, or alternatively, welding, brazing, bolts, screws, integral latches, or other mechanical fasteners. Thus, if a striking surface is attached to a putter head using high strength epoxy, welding, brazing, bolts, screws, or integral latches as a permanent attachment, the striking surface is not quickly removable.

In another attempt at adjustable customization, U.S. Pat. Nos. 5,690,561 and 5,688,190 to Rowland et al. disclose the removable application of textured adhesive backed pads to a club face. However, the use of temporary adhesive will over time fail to provide a positive lock as the effectiveness of the adhesive deteriorates with use.

Thus, conventional adjustable customized golf putters fail to satisfy golfers' preferences for easily customizing or fine-tuning the putter to adapt to changing playing styles or changing playing conditions. Putters fastened with screws or similar fasteners can require tools and can prolong replacement of the striking surface insert such that a golfer experimenting with different inserts loses the unique feel of the prior inserts. In short, the striking surface inserts of these types of putters are not quickly removable. In addition, the golfer can lose the screws or similar fasteners, making the club useless.

Although simplifying adjustment, the conventional adjustable customized putters that use interference fits or temporary adhesive also fail to positively secure the insert. The interference fits fail, in part, due to the many variables in manufacturing, including shrinkage and process variations that contribute to inconsistent shapes and dimensions. The consequence of this inconsistency is an undesirable looseness. Likewise, the temporary adhesives do not provide a positive lock and, in addition, deteriorate over time.

As used herein, "looseness" is defined by any independent movement of a club component perceptible to a golfer while using the club to strike a ball. Perceptible includes feeling or hearing independent movement. For example, feeling or hearing a rattle is indicative of looseness. Looseness in a putter prevents replication of the feel of a fixed face putter, and prevents even acceptable performance of the putter.

SUMMARY OF THE INVENTION

The present invention is an adjustable customized golf club that positively locks a striking surface attachment to a club head and provides for the quick replacement of the striking surface attachment. The representative embodiment of the golf club is a golf putter. However, as one of ordinary skill in the art would appreciate, the present invention applies equally well to other types of golf clubs, such as wedges, drivers, fairway woods, and irons. According to the representative embodiment, the primary components of the putter include a putter head, a striking surface attachment, and one or more lock fittings. The striking surface attachment is fixed to a front face of the putter head by the one or more lock fittings.

With one lock fitting, the present invention positively locks the striking surface attachment to the putter head without looseness. As used herein, to "positively lock" or to "provide a positive lock" means to firmly fix a club component without looseness as if it were part of a fixed-face putter, while still allowing quick removal and replacement of the component. In a representative embodiment, a player can break the positive lock by hand and without the use of tools to remove and replace a component, such as the striking surface attachment. As used herein, "toolless" and "toollessly" refer to this removing and replacing of components without the use of tools. Also, as used herein, a "tool" refers to a device that is primarily designed to join or separate components, and, specifically, does not include a golf tee, coin, key (e.g., a house key or car key), ball mark repairer, or other similar devices that are intended merely to assert force on a component for disassembly in places not accessible by hand. A positive lock releasably bonds components, but does not create a permanent attachment such as is typically found between a club shaft and club head. In contrast to a positive lock, a permanent attachment can only be broken by a destructive force that damages the components.

Also, as used herein, the terms "quick" and "quickly," when used in relation to removing, replacing, or attaching a component, e.g., a striking surface attachment, encompass actions completed with speed and without delay, such that, for example, a typical player does not lose the feel of a prior component configuration, i.e., does not forget how the prior component configuration felt. Examples of component attachments that satisfy this criteria include a component that magnetically bonds to another component; a component that hooks to or onto another component; a component that compresses into or out of another component; a component that stretches around another component; a component that slides into, over, around, or on another component; a component that snaps into, over, around, or on another component; a component that wedges inside or around another component; a component that clips into, over, around, or on another component; a component that rolls into, over, around, or on another component; a component that twists into, over, around, or on another component; a component that swells or expands into or around another component; and a component that grips onto, around, or over another component. In contrast, examples of component attachments that do not satisfy the criteria of "quick" and "quickly" include a wedged, permanent fit, a wedged fit with adhesive, and an attachment using screws. Of course, components that can only be separated by a destructive force, such as with the permanent fit or the wedged fit with adhesive, do not satisfy the criteria of "quick" and "quickly."

When multiple lock fittings fix the striking surface attachment to the putter head, a first preferred embodiment of the present invention includes at least a primary lock fitting and a secondary lock fitting. The primary lock fitting releasably secures the striking surface attachment to the front face of the putter head and provides the strong, tight fit required to eliminate looseness. The secondary lock fitting can also contribute to the strong, tight fit, but at a minimum retains and aligns the striking surface attachment in the putter head before the primary lock fitting positively locks the striking surface attachment to the putter head.

The striking surface attachment can be a single component or can be constructed of a striking surface and a support member or members supporting the striking surface. In either case, the one or more lock fittings act on the single or multiple components to positively lock all components of the putter.

For a single lock fitting configuration, the lock fitting is a component that connects the striking surface attachment to the putter head by a bond strong enough to eliminate looseness but weak enough to enable easy disassembly and assembly (which can be toolless). For a multiple lock fitting configuration, the multiple lock fittings together connect the striking surface attachment to the putter head and provide the bond strong enough to eliminate looseness, yet nevertheless enable easy disassembly and assembly (which can be toolless). As such, a lock fitting can be mechanical, magnetic, or frictional (i.e., interference fit). In a preferred embodiment, the lock fitting is a magnet that positively locks the striking surface attachment to the putter head. In further preferred embodiments, the lock fitting is a hook and loop fastener; a press-fit adaptor; a flexible rib; a locking pin; spring-loaded bearings; a quick-turn fastener; a cap nut and threaded extension; a spring rod with a catch-and-release mechanism; a spring-loaded catch-and-release; a spring clip; a swell fastener; a spring latch; a flexible strap; a dovetail slot; and, a lap joint. Although these embodiments describe specific types of lock fittings, other equivalent types could suffice without departing from the spirit and scope of the present invention.

In addition to the structure described above, the present invention also provides a method for replacing a striking surface attachment of a head. According to this method, a golfer removes the striking surface attachment by breaking the bond created by the one or more lock fittings. In a toolless embodiment of the one or more lock fittings, the golfer uses her hands and possibly an ordinary golf accessory (e.g., a golf tee or ball mark repairer) to disengage the striking surface attachment without tools. For example, with a magnetic lock fitting, the golfer pushes the striking surface attachment away from the head using her finger if an opening (such as a screw hole) in the head is large enough and, if not, using a golf tee placed through the opening. With the striking surface attachment and head separated, the golfer can choose another striking surface attachment with different performance characteristics. The golfer then engages that striking surface attachment with the head as required by the one or more lock fittings, e.g., for magnetic fasteners, the golfer aligns the striking surface attachment with the head and brings the components close to each other until the magnetic field takes hold. The golfer can repeat this method of the present invention as many times as desired, to experiment with the club in a store before purchasing it, and later, on the golf course, before commencing a round of golf to adapt to changing playing preferences and playing conditions. Thus, the bonding characteristics of the one or more lock fittings enable quick adjustments, and timely, tactile comparisons of striking surface attachments.

Accordingly, an object of the invention is to provide a golf club having a firmly fixed and positively locked replaceable striking surface attachment that can be quickly removed and replaced with another striking surface attachment.

Accordingly, an object of the invention is to provide a golf club having a firmly fixed and positively locked replaceable striking surface attachment that can be quickly and toollessly removed and replaced with another striking surface attachment.

Another object of the present invention is to provide one or more lock fittings to secure a striking surface attachment to a golf club head by a bond strong enough to eliminate looseness of the components but weak enough to enable toolless disassembly and assembly.

Another object of the invention is to provide a golf club that accepts striking surface attachments that can be quickly changed on a golf course or in a store to enable comparison of one attachment to another without losing the feel of the prior attachment(s).

Another object of the present invention is to provide a golf putter that golfers can quickly fine-tune to accommodate varying playing conditions, putting styles, ball types, and putting strokes.

Another object of the present invention is to provide a golf club having a firmly fixed and positively locked replaceable striking surface attachment that can be quickly and toollessly removed and replaced with another striking surface attachment, and to provide, when necessary to avoid any potential USGA rules conflict or if otherwise desirable, a further securing of the striking surface attachment to the head by screws or other similar means.

These and other objects and advantages of the present invention are described in greater detail in the detailed description of the invention, and the appended drawings. Additional features and advantages of the invention will be set forth in the description that follows, will be apparent from the description, or may be learned by practicing the invention.

DESCRIPTION OF THE DRAWINGS

FIGS. 16A–16E are schematic diagrams of striking surface attachments with rib configurations that accept weights, according to a representative embodiment of the present invention.

FIG. 16F is a schematic diagram of a vertical cross section of the center portion of the striking surface attachment shown in FIG. 16E.

DETAILED DESCRIPTION OF THE INVENTION

The present invention is an adjustable customized golf club with a replaceable striking surface attachment, and a method for replacing the striking surface attachment. The representative embodiment of the golf club is a golf putter.

Figure 1:
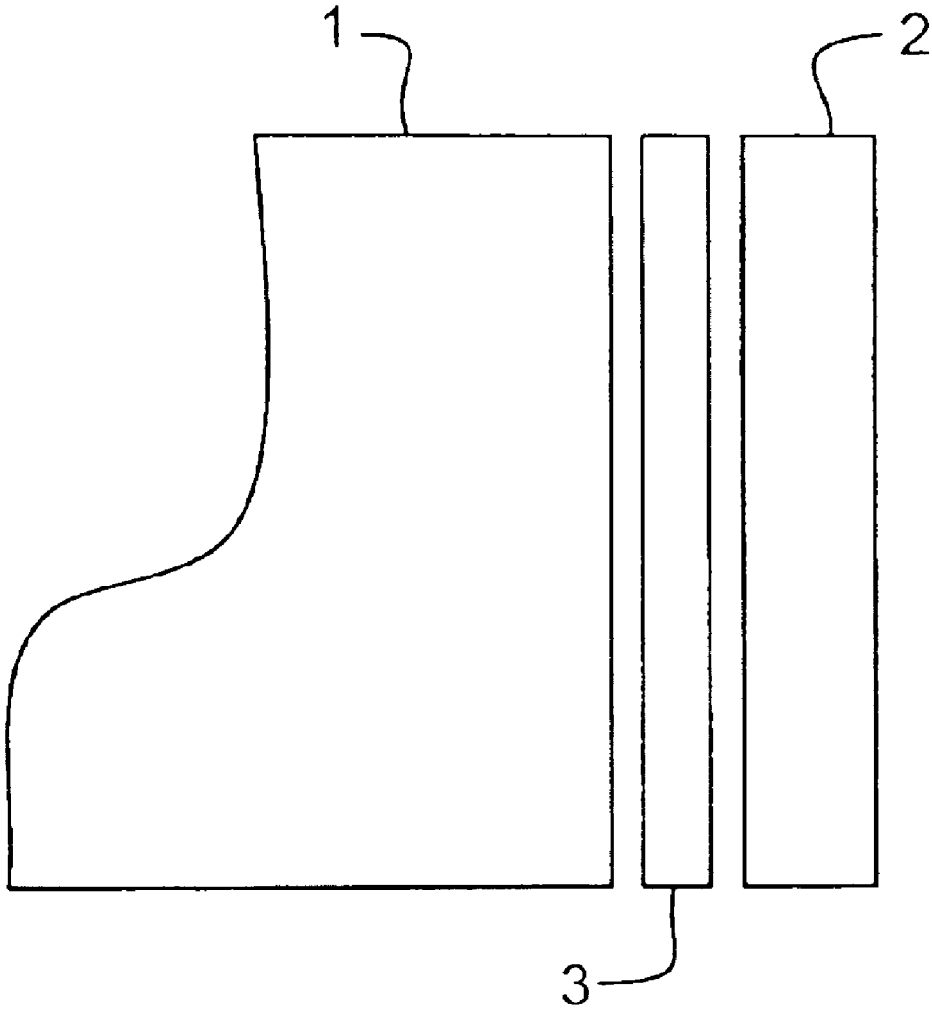
FIG. 1 is a schematic diagram of an adjustable customized putter, according to a representative embodiment of the present invention.

Referring to FIG. 1, the present invention, broadly stated, includes a putter head 1, a striking surface attachment 2, and one or more lock fittings 3. The configuration of putter head 1 is designed to match the configuration of striking surface attachment 2 such that the two components fit squarely and tightly together. For example, putter head 1 can have a cavity into which a matching shaped portion of striking surface attachment 2 fits. The one or more lock fittings 3 positively lock striking surface attachment 2 to putter head 1 such that striking surface attachment 2 does not loosen, yet still permit quick removal of striking surface attachment 2. This firmly fixed but quickly breakable bond provided by the one or more lock fittings is a critical aspect of the present invention. In a further representative embodiment, a player can toolessly form and break the firmly fixed but quickly breakable bond.

Although FIG. 1 shows a single lock fitting positively locking striking surface attachment 2 to putter head 1, more than one lock fitting can be used to create this unique bond. With multiple lock fittings, the present invention includes at least a primary lock fitting and a secondary lock fitting. Either one or both of the primary lock fitting and the secondary lock fitting provide the bond strong enough to eliminate looseness but weak enough to enable quick disassembly and assembly.

Striking surface attachment 2 is one of a plurality of striking surface attachments that can be fixed to putter head 1. Each striking surface attachment has differing rebound and hardness characteristics, and can be made of elastomeric or non-elastomeric materials. Although shown as a single component in FIG. 1, striking surface attachment 2 can also be constructed of two or more components. For example, striking surface attachment 2 could comprise a striking surface and one or more support members supporting the striking surface.

Thus, with a plurality of striking surface attachments and the unique bond provided by one or more lock fittings 3, the present invention provides an adjustable customized putter that can be quickly fine-tuned to an individual's preferred feel to cooperate with differently constructed golf balls or to respond to the variable conditions of putting greens. Using the present invention, a golfer can quickly change striking surface attachments without losing the feel of the replaced striking surface attachment, enabling her to compare the differences between the striking surface attachments. Once a golfer finds a striking surface attachment that fits her needs, one or more lock fittings 3 positively lock striking surface attachment 2 to putter head 1 to create the secured, firmly fixed attachment.

In light of the above-described primary components of the present invention, the following discussion describes examples of preferred embodiments of the structures and methods of the present invention. Although the present invention is applicable to any adjustable customized putter with a striking surface attachment positively locked (but quickly removable) by one or more lock fittings to a putter head, the following description and schematics outline specifically designed components that implement this inventive concept. These specific designs should not be construed as limitations on the scope of the invention, but rather as examples of putter components and lock fittings that could be used to practice the invention. As would be apparent to one of ordinary skill in the art, many other variations on the components are possible, including different shapes, geometries, and component configurations. In addition, to provide a complete putter, many other ancillary components could be added to the primary components of the present invention, including, for example, a putter shaft and hosel. Accordingly, the scope of the invention should be determined not by the embodiments illustrated, but by the appended claims and their equivalents.

With regard to the drawings, wherever possible, the same reference numbers are used throughout to refer to the same or like parts.

Figure 1A:
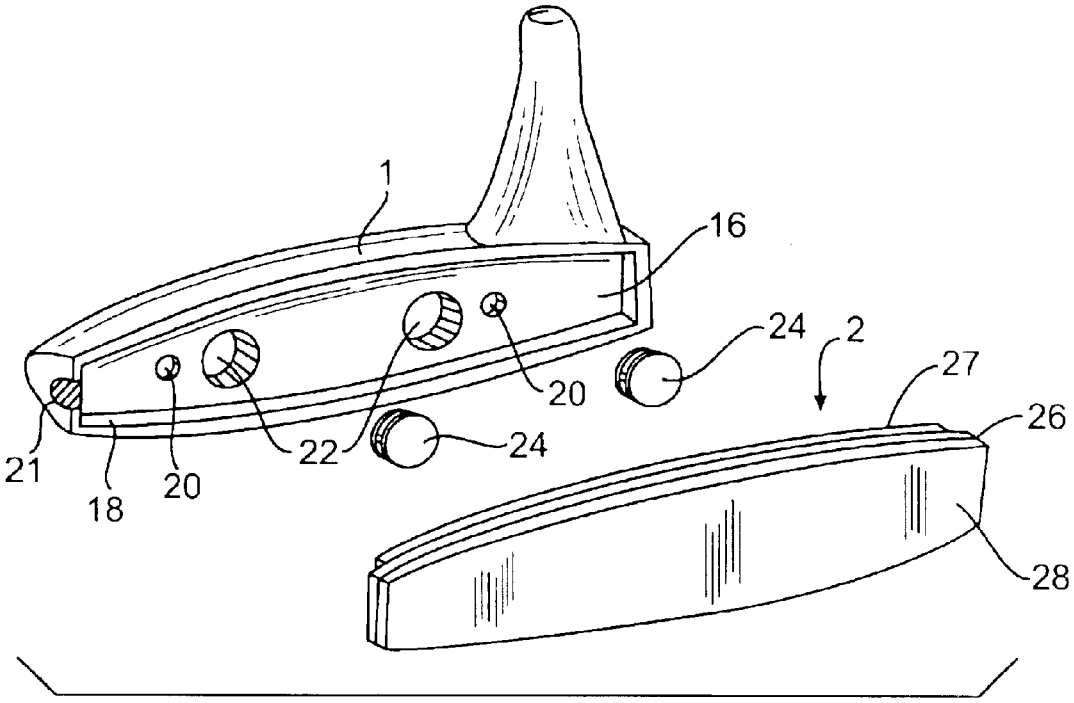
FIGS. 1A–1C are schematic diagrams of exploded perspective views of an adjustable customized putter with magnetic lock fittings, according to a representative embodiment of the present invention.
Figure 1B:
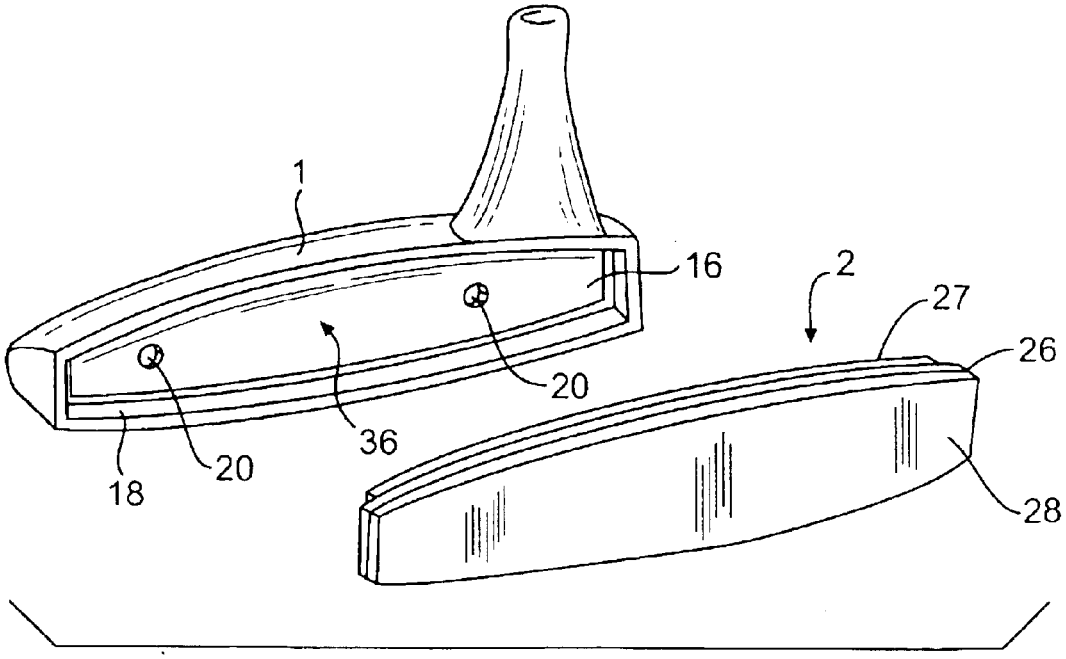
Figure 1C:
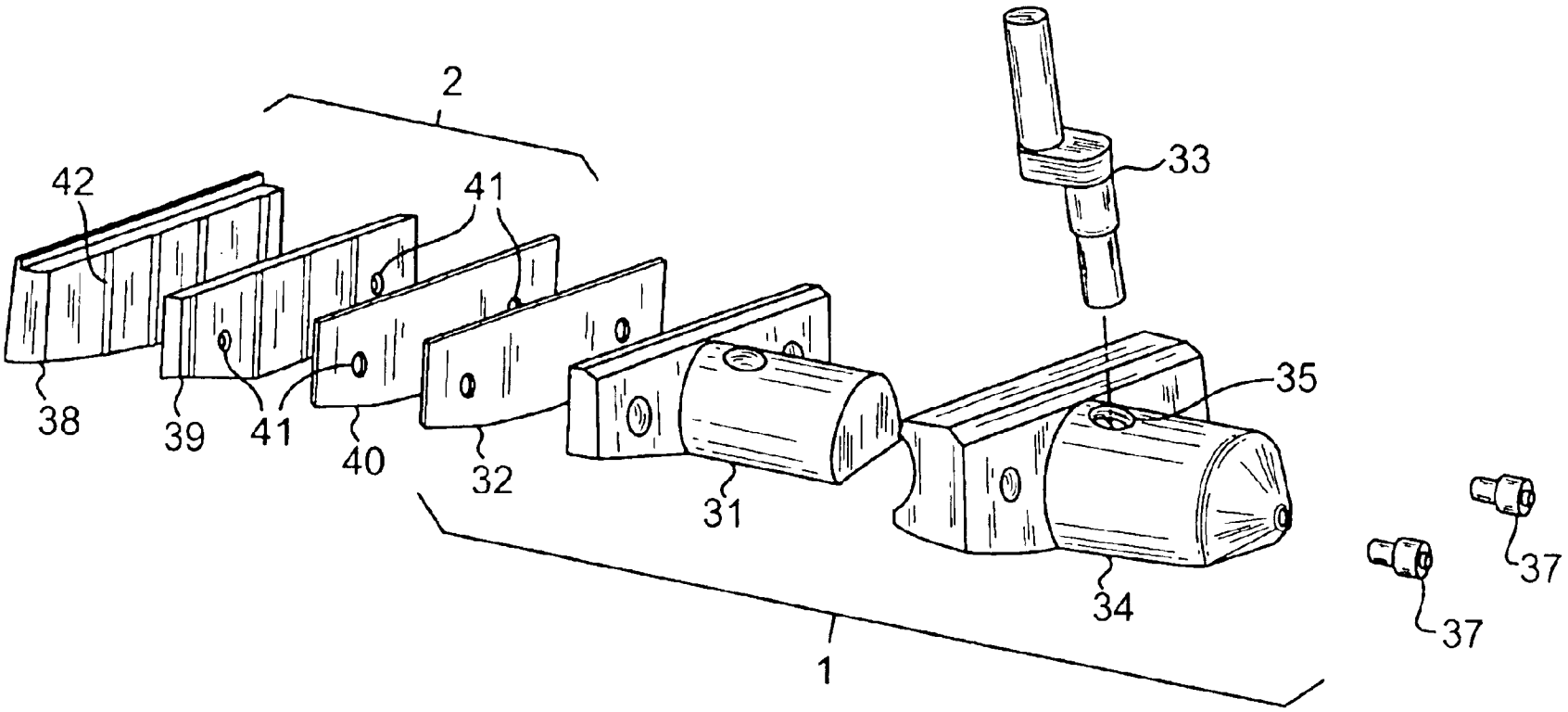

Referring to FIGS. 1A–1C, a first preferred embodiment of the present invention uses magnets as the one or more lock fittings 3. In FIG. 1A, magnetic discs 24 positioned in recesses 22 of putter head 1 positively lock striking surface attachment 2 to putter head 1. In FIG. 1B, the magnetic sheet 36 adhered to putter head 1 positively locks striking surface attachment 2 to putter head 1. FIG. 1C illustrates the use of a first magnet 32 on the putter head 1 and a second magnet 49 on the striking surface attachment 2 to provide the positive lock. In this example, the first magnet 32 and second magnet 40 are magnetic sheets.

For each of the embodiments illustrated in FIGS. 1A–1C, an example of a suitable magnet is a multiple pole magnet, such as a Plastalloy 6™ magnet produced by Electrodyne of Batavia, Ohio. However, as one of ordinary skill in the art would appreciate, other types of magnets could be used, including various types of solid and bonded magnets.

In both FIGS. 1A and 1B, at least a portion of striking surface attachment 2 must be metallic or magnetic to facilitate the bond with magnetic discs 24 and magnetic sheet 36. For example, in FIGS. 1A and 1B, striking surface attachment 2 comprises a support member 26 with a metallic back plate 27 mounted on one side and a striking surface 28 mounted on the other. Alternatively, metallic back plate 27 can be a magnetic sheet with a polarity opposite to the polarities of magnetic discs 24 and magnetic sheet 36. Also, alternatively, the locations of magnetic discs 24 and metallic back plate 27 or magnetic sheet 36 could be switched such that magnetic discs 24 are on striking surface attachment 2 while metallic back plate 27 or magnetic sheet 36 are on putter head 1.

Although the magnetic bond alone can positively lock striking surface attachment 2 to putter head 1, both FIGS. 1A and 1B incorporate a secondary lock fitting by having a cavity 18 in the front face 16 of putter head 1. Cavity 18 is sized and shaped to receive striking surface attachment 2 in a tight, secured fit. Through minimizing tolerances between cavity 18 and striking surface attachment 2, by for example using all injection molded components, the secondary lock fitting provided by cavity 18 contributes to the positive locking of striking surface attachment 2.

Alternatively, magnetic discs 24 and magnetic sheet 36 could be hook and loop fasteners, or other similar planar fasteners that provide a positive lock. In such cases, metallic back plate 27 would be made of an appropriate complementary surface.

For FIGS. 1A and 1B, removing striking surface attachment 2 from putter head 1 is accomplished by applying a force to striking surface attachment sufficient to overcome the magnetic field between magnetic discs 24 and metallic back plate 27 or magnetic sheet 36. Preferably, a golfer inserts a golf tee into either of passageways 20, which extend from front face 16 to the exterior of putter head 1. The golf tee breaks the positive lock and pushes striking surface attachment 2 out of cavity 18. Alternatively, a player pulls striking surface attachment 2 out of cavity 18 by inserting his finger into depression 21 located on the front toe (as in FIG. 1A) and/or the rear heel of putter head 1, or anywhere along the perimeter of front face 16. As another alternative, cavity 18 can be deeper in one section such that pushing striking surface attachment 2 in the deeper area raises the opposite end of striking surface attachment 2 for quick removal.

FIG. 1C illustrates an exploded view of a putter that uses magnets for the one or more lock fittings 3. As shown, the putter includes a putter head 1 that includes a metal core 31, a sheet magnet 32 attached to the face of the metal core 31, and a shell 34 molded over and bonded to the entire surface of metal core 31, except for the face of metal core 31. Shell 34 is preferably made of Surlyn™. Putter head 1 also includes a shaft 33 attached to an opening 35 in shell 34 and metal core 31, as well as fasteners 37 that join sheet magnet 32, metal core 31, and shell 34 together. Fasteners 37 also preferably extend beyond sheet magnet 32 to align striking surface attachment 2 onto putter head 1, by engaging openings in one or more components of striking surface attachment 2.

Striking surface attachment 2 includes a striking surface 38 molded onto at least the face of a support member 39, and a sheet magnet 40 attached to a face of support member 39 opposite striking surface 38. Striking surface 38 is preferably an elastomer molded around the front face and edges of support member 39. Support member 39 is preferably made of metal. To improve the bond between striking surface 38 and support member 39, striking surface 38 preferably includes strips 42 that align with grooves (not shown) in support member 39. Sheet magnet 40 has a polarity opposite of sheet magnet 32 to provide the positive lock between striking surface attachment 2 and putter head 1. Moreover, sheet magnet 40 and support member 39 preferably have openings 41 that receive fasteners 37 to align striking surface attachment 2 with putter head 1.

Figure 1D:
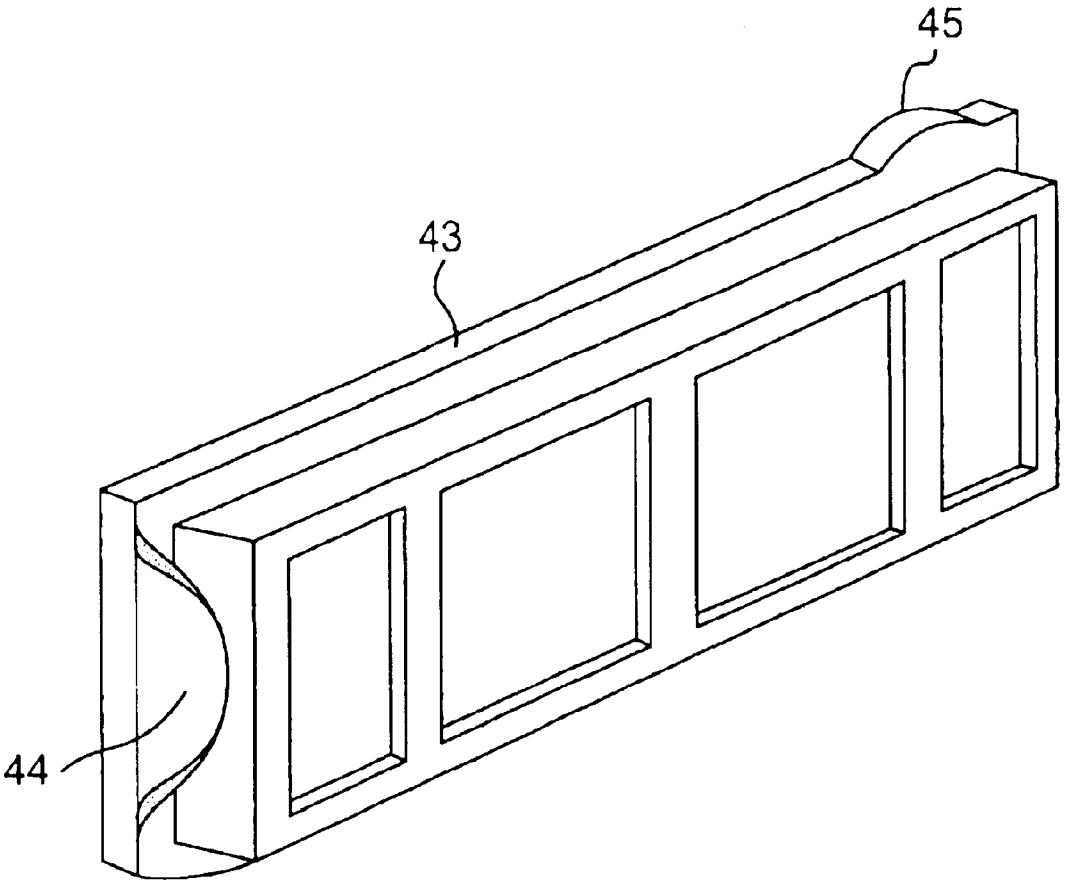
FIG. 1D is a schematic diagram of an enlarged view of the striking surface shown in FIG. 1C.

To remove striking surface attachment 2 from putter head 1 of the putter of FIG. 1C, a player must apply a force to striking surface attachment sufficient to overcome the magnetic field between sheet magnets 32 and 40. Preferably, a golfer grasps striking surface 38 and pulls striking surface attachment 2 away from putter head 1 to quickly break the positive lock. To assist a player's grasp of striking surface attachment 2, striking surface 38 preferably includes a grip member, such as a flange or ridge 43, an indentation 44, or a tab 45, as shown in FIG. 1D. An indentation could also be provided in putter head 1 to assist a player's grasp of striking surface attachment 2.

Figure 2A:
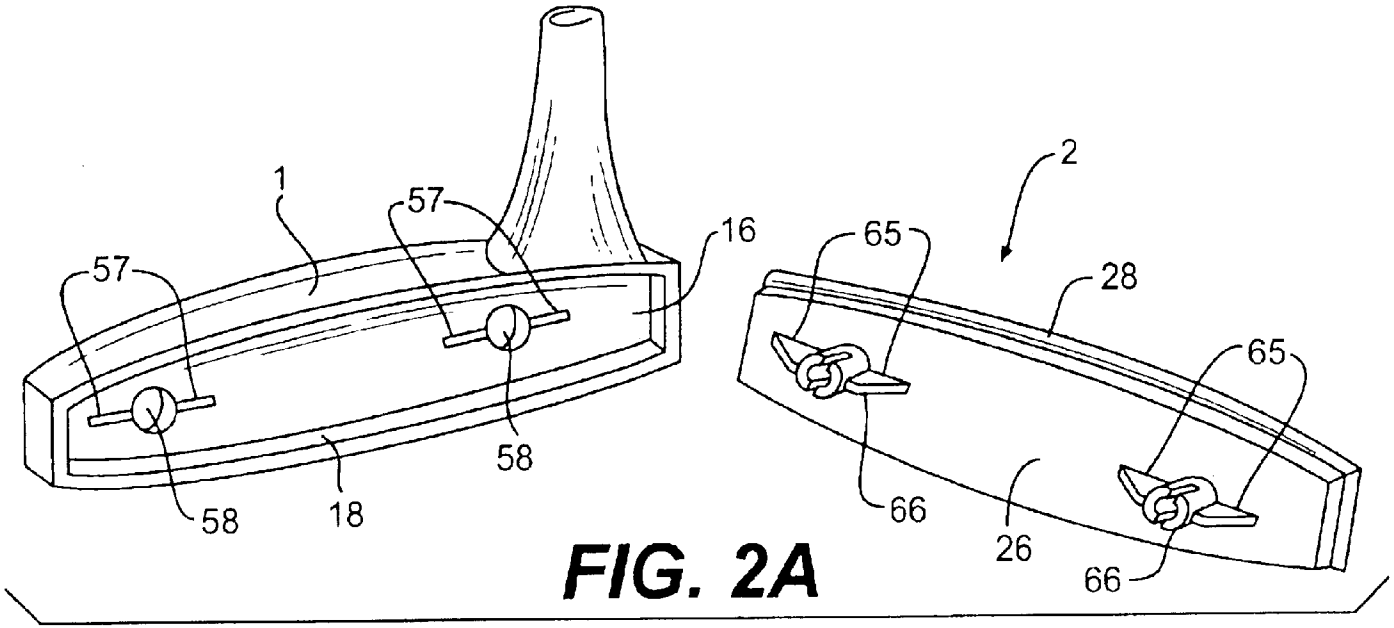
FIG. 2A is a schematic diagram of an exploded perspective view of an adjustable customized putter head with press-fit adaptor lock fittings, according to a representative embodiment of the present invention.
Figure 2B:
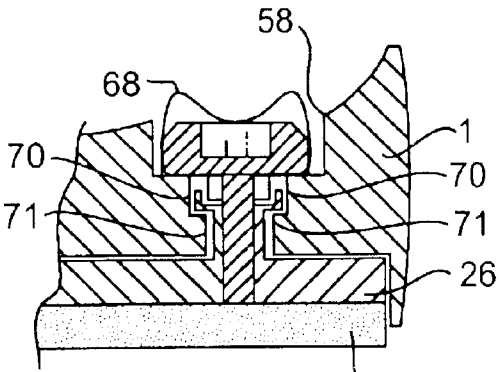
FIGS. 2B–2F are schematic diagrams of horizontal cross sectional views of variations of the putter shown in FIG. 2A.
Figure 2C:
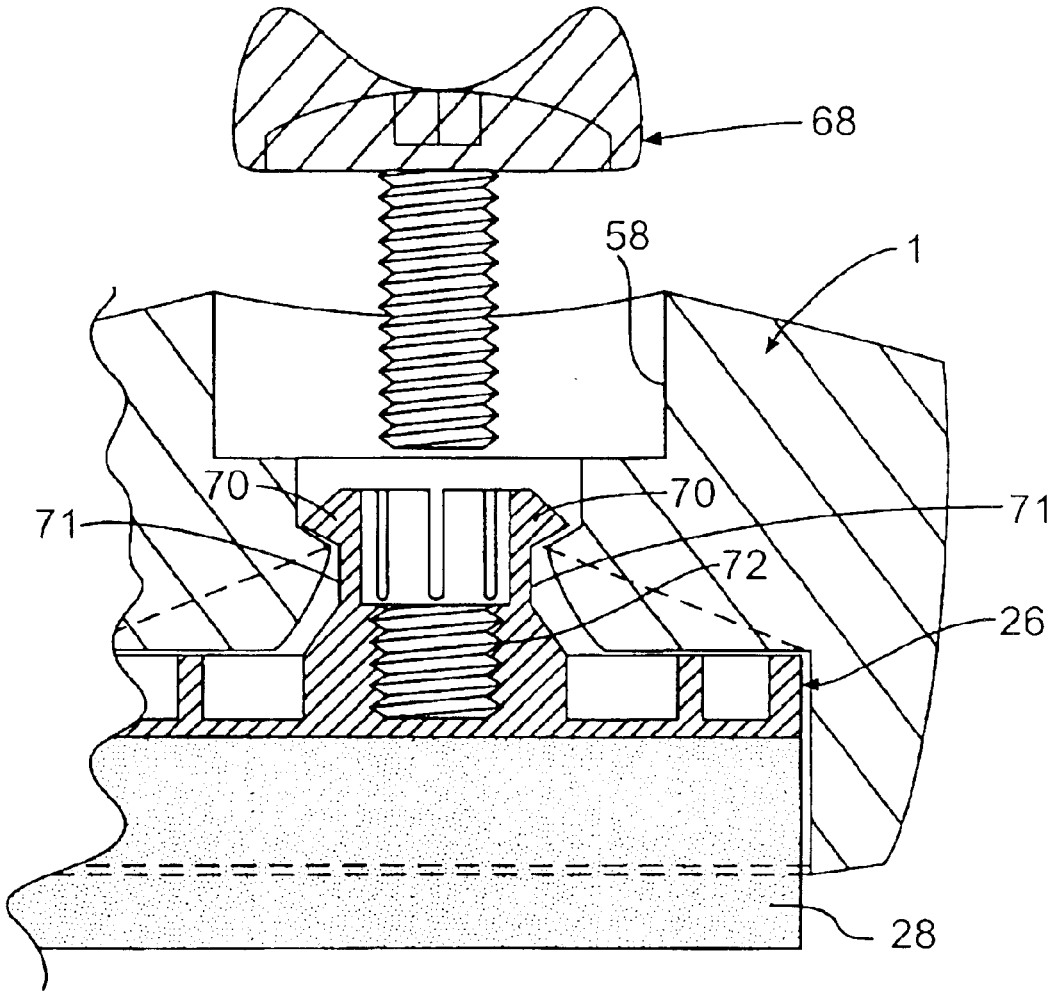

Referring to FIGS. 2A–2F, a second preferred embodiment of the present invention uses press-fit adaptors 66 as the one or more lock fittings 3. As shown in FIG. 2A, press-fit adaptors 66 are attached to striking surface attachment 2, which in this case is comprised of a striking surface 28 mounted on a support member 26. Press-fit adaptors 66 are located to align with openings 58 in the front face 16 of putter head 1. Openings 58 can, but do not have to, extend to the exterior of putter head 1, depending on the desired method of removing striking surface attachment 2. As shown in FIGS. 2B and 2C, press-fit adaptors 66 are generally of a tubular shape and include ridges 65 and a distal portion 70 wider than an intermediate portion 71. Ridges 65 mate with ridge recesses 57 in front face 16 for alignment purposes. Distal portion 70 press-fits into openings 58, compresses through the narrow section of openings 58, and expands at the wide section of openings 58 to abut against the back of putter head 1. Once expanded, distal portion 70 of press-fit adaptors 66 holds striking surface attachment 2 firmly in place to provide the positive locking.

Figure 2E:
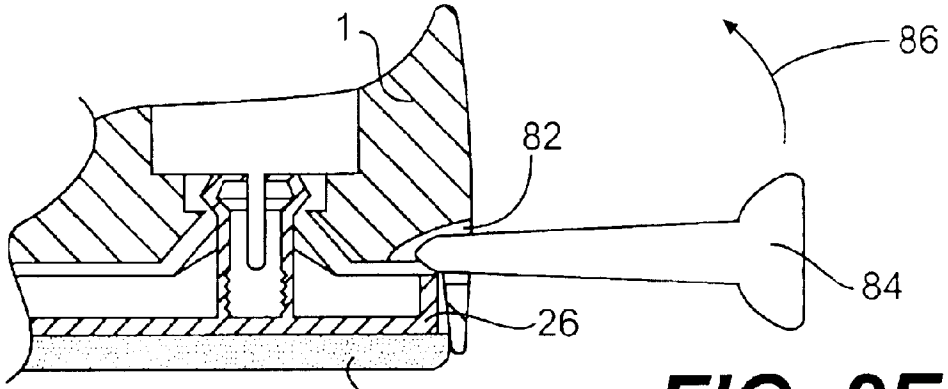
Figure 2F:
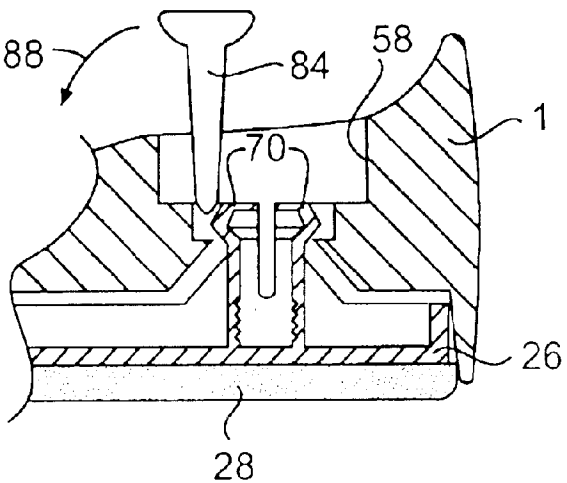
Figure 2D:
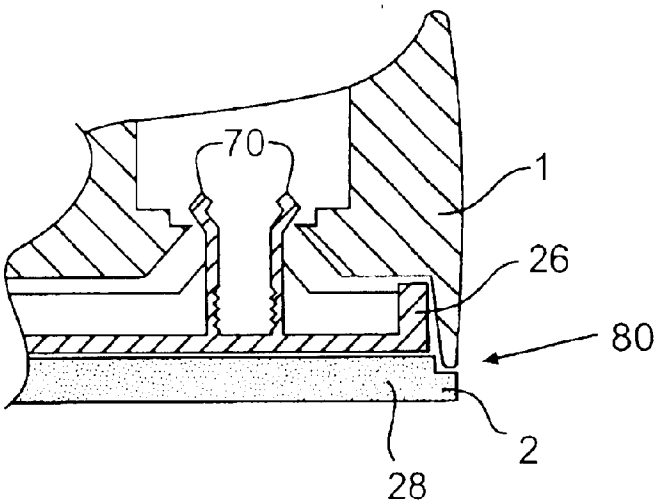

FIGS. 2D–2F illustrate various methods for removing striking surface attachment 2, along with corresponding structural variations. In FIG. 2D, striking surface 28 of striking surface attachment 2 overlaps the end of putter head 1 such that a force 80, applied for example by a fingertip or golf tee, quickly breaks the positive lock of press-fit adaptors 66 and disengages striking surface attachment 2. In FIG. 2E, an opening 82 in putter head 1 accepts a golf tee 84 that applies a torque 86 to push striking surface attachment 2 from behind and quickly break the positive lock. In FIG. 2F, opening 58 extends to the exterior of putter head 1 to accept a golf tee 84 that applies a torque 88 to distal portion 70, which compresses distal portion 70 for passage through opening 58. As an alternative to the removal methods shown in FIGS. 2D–2F, a golfer could simply grip the perimeter of striking surface attachment 2 and pull it away from putter head 1 until distal portion 70 compresses and the components disengage.

In addition to press-fit adaptors 66, FIGS. 2A–2F show the use of cavity 18 as a secondary lock fitting in the same manner as described for the first embodiment (FIGS. 1A and 1B). Further, FIGS. 2A–2F show a toolless screw fastener 68 as a third lock fitting. Toolless screw fastener 68 is any fastener operated by hand without tools, e.g., a wing screw as shown. For this third lock fitting, press-fit adaptors 66 have interior threaded portions 72 to receive toolless screw fastener 68. Thus, overall, FIGS. 2A–2F show three lock fittings, each of which contribute to the positive locking or alignment of striking surface attachment 2.

Figure 3A:
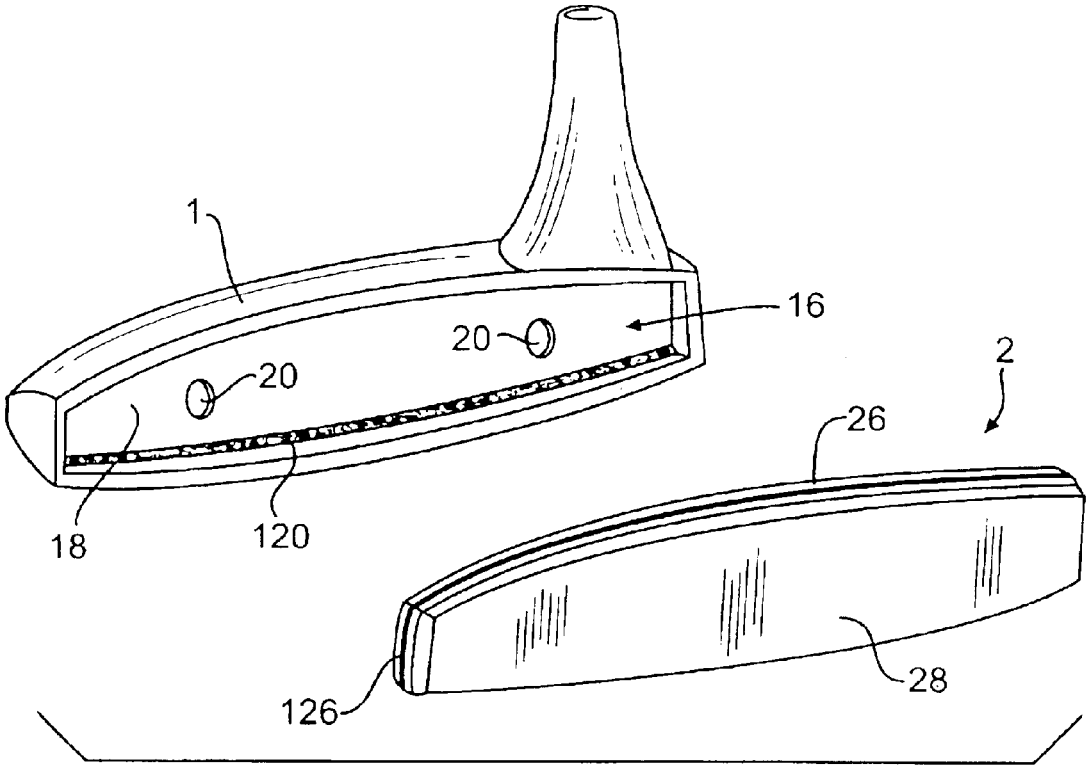
FIG. 3A is a schematic diagram of an exploded perspective view of an adjustable customized putter with flexible rib lock fittings, according to a representative embodiment of the present invention.
Figure 3B:
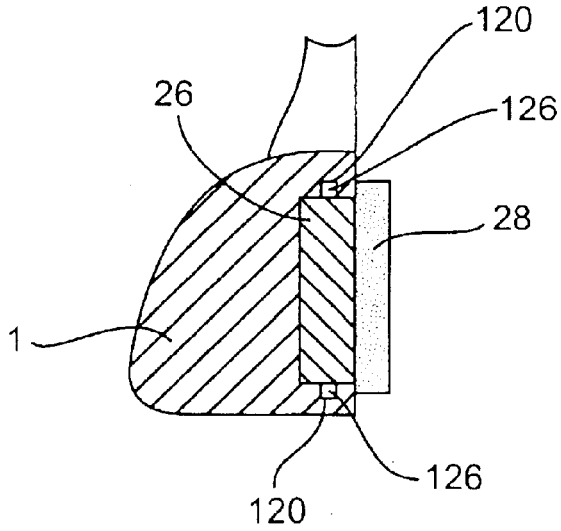
FIG. 3B is a schematic diagram of a vertical cross section of the putter shown in FIG. 3A.

Referring to FIGS. 3A–3D, a third preferred embodiment of the present invention uses a flexible rib 126 as the one or more lock fittings 3. In FIGS. 3A and 3B, flexible rib 126 is provisioned on the outer periphery of striking surface attachment 2 and striking surface attachment 2 is comprised of a striking surface 28 mounted on a support member 26, with flexible rib 126 mounted on support member 26. Flexible rib 126 is preferably an elastomeric material, but can be any material capable of bending, twisting, and compressing, and having memory to retain an original shape.

To create the positive lock in this third embodiment, striking surface attachment 2 is force fitted into cavity 18 of putter head 1. Flexible rib 126 deforms to pass into cavity 18. Once striking surface attachment 2 sets against front face 16, flexible rib 126 aligns with a groove 120 in the periphery of cavity 18. The additional space from groove 120 enables flexible rib 126 to expand to its original shape and to positively lock striking surface attachment 2 to putter head 1.

In addition to flexible rib 126, the example in FIGS. 3A–3B uses cavity 18 itself as a secondary lock fitting in the same manner as described for the first embodiment (FIGS. 1A and 1B).

Figure 3C:
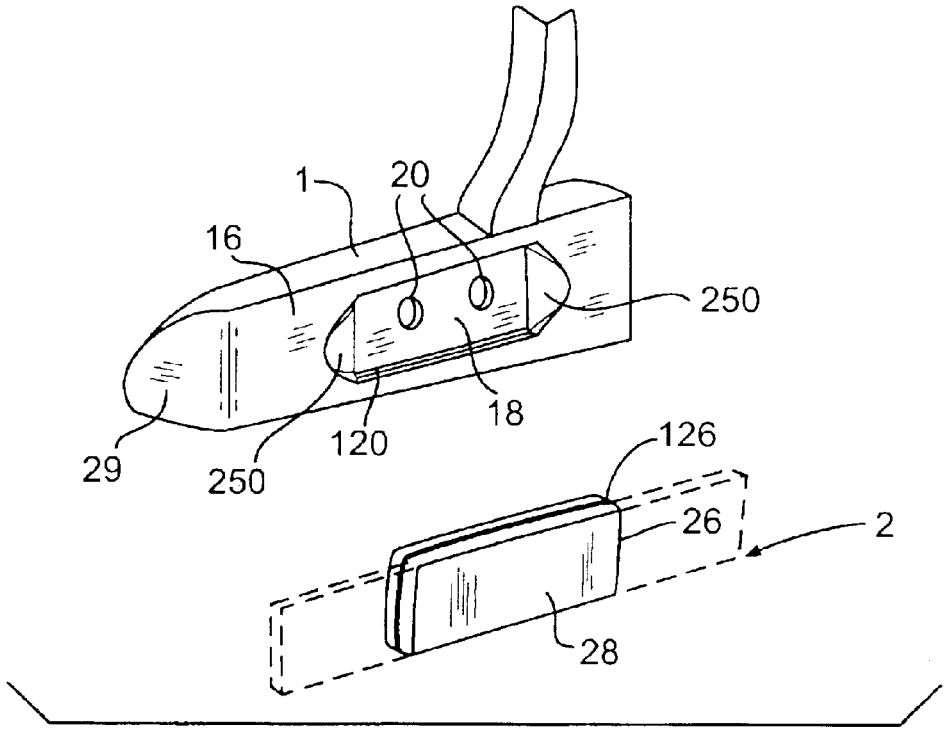
FIG. 3C is a schematic diagram of an exploded perspective view of an adjustable customized putter with a flexible rib lock fitting and a putter head cavity smaller than the putter head face, according to a representative embodiment of the present invention.
Figure 3D:
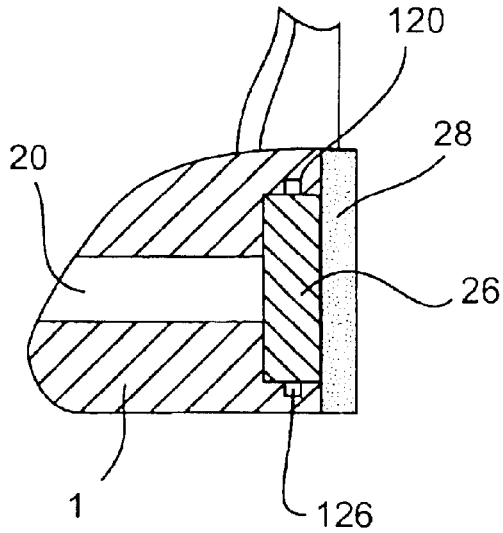
FIG. 3D is a schematic diagram of a vertical cross section of the putter shown in FIG. 3C.

FIGS. 3C and 3D illustrate two alternate embodiments of the flexible rib lock fitting. First, instead of taking up the entire front face 16 of putter head 1, cavity 18 and striking surface attachment 2 can be smaller than front face 16 and occupy only the area where the putter should strike a golf ball. The solid lines representing striking surface attachment 2 in FIG. 3C illustrate this alternate embodiment. Notably, this alternate sizing would apply to this and any other embodiment in which a striking surface attachment rests within a cavity.

In the second alternate embodiment, as an alternative to having striking surface attachment 2 fit within cavity 18 as shown in FIGS. 3A and 3B, striking surface attachment 2 can comprise a striking surface 28 mounted on a smaller support member 26 that fits within a cavity 18 smaller than front face 16. FIGS. 3C (with the dotted lines showing striking surface 28 of striking surface attachment 2) and 3D show this alternate embodiment.

In both alternate embodiments of FIGS. 3C and 3D, support member 26 of striking surface attachment 2 has a flexible rib 126 that functions as described above for FIGS. 3A and 3B.

To quickly remove striking surface attachment 2 in this third embodiment shown in FIGS. 3A–3D, passageways 20 provide a channel into which a golf tee can be inserted to push striking surface attachment 2 from behind and break the positive lock. Alternatively, cavity 18 can be deeper in portions such that pushing on an area of striking surface attachment 2 causes an opposite end of striking surface attachment 2 to break the positive lock and raise away from front face 16. Or, alternately, a golfer could grip striking surface attachment 2, perhaps at striking surface 28, and pull to disengage the components. With a smaller cavity 18 and a striking surface attachment 2 having a smaller support member 26 with a larger striking surface 28 (dotted lines in FIG. 3C), a golfer can easily grasp the edges of striking surface 28, perhaps with the aid of an indentation such as indentation 29 in putter head 1 of FIG. 3C. With a smaller cavity and a striking surface attachment 2 having a support member 26 with an equally-sized striking surface 28 (solid lines in FIG. 3C), indentations 250 proximate to cavity 18 in front face 16 can facilitate a golfer's grasping and removing striking surface attachment 2.

Figure 4A:
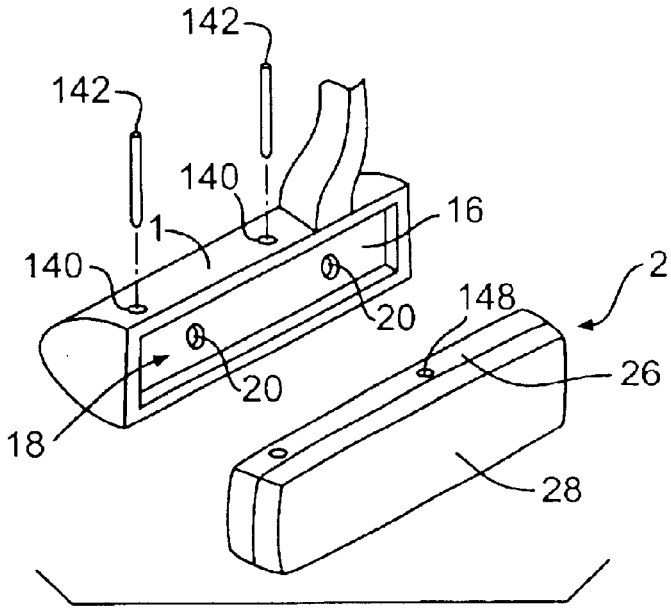
FIG. 4A is a schematic diagram of an exploded perspective view of an adjustable customized putter with locking pin lock fittings, according to a representative embodiment of the present invention.
Figure 4C:
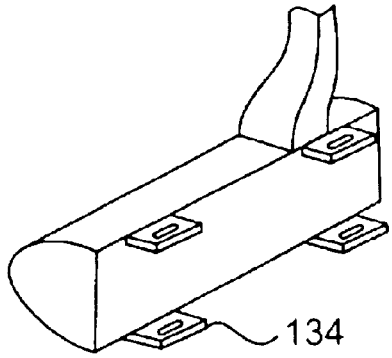
FIG. 4C is a schematic diagram of a putter head with channeled tabs for use with locking pin lock fittings, as alternative to the putter head shown in FIG. 4A, according to a representative embodiment of the present invention.
Figure 4B:
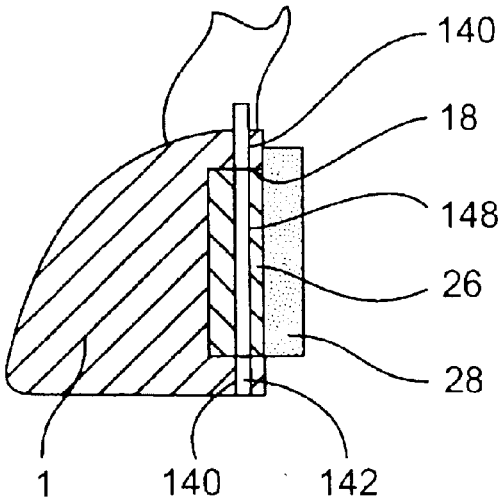
FIG. 4B is a schematic diagram of a vertical cross section of the putter shown in FIG. 4A.

Referring to FIGS. 4A and 4B, a fourth preferred embodiment of the present invention uses locking pins 142 as the one or more lock fittings 3. Striking surface attachment 2, which in this case is comprised of a striking surface 28 mounted on a support member 26, is provisioned with channels 148 through support member 2. Channels 148 are located to align with channels 140 in putter head 1. Channels 140 penetrate the wall of putter head 1 within the cavity 18 such that when striking surface attachment 2 is set against the front face 16 of putter head 1, channels 140 line up with channels 148 for insertion of locking pins 142. Although, channels 140 appear only on the top of putter head 1 in FIG. 4A, bottom matching channels could be added as shown in FIG. 4B, which may or may not penetrate the exterior of putter head 1. Further, although channels 140 are shown penetrating putter head 1 into cavity 18, as shown in FIG. 4C, channels 140 could also work with channeled tabs 134 that extend from the front face 16 such that striking surface attachment 2 could be positively locked to putter head 1 without needing cavity 18.

Locking pins 142 preferably rest within channels 140 and 148 in an interference fit, free of vibration and looseness. Also, preferably locking pins 142 extend from above the top or bottom surface of the exterior of putter head 1 for convenient grasping and removal, although locking pins extending from other sides of the exterior of the putter head are possible. Locking pins 142 may also have knobs or other extensions that ease grasping. For quick disassembly, once locking pins 142 are removed, a golfer grasps striking surface attachment 2 and pulls it away from putter head 1. Or, alternatively, once locking pins 142 are removed, a golfer inserts a tee through passageways 20 to push striking surface attachment 2 free.

In addition to locking pins 142, FIGS. 4A–4B show the use of cavity 18 itself as a secondary lock fitting in the same manner as described for the first embodiment (FIGS. 1A and 1B).

Figure 4D:
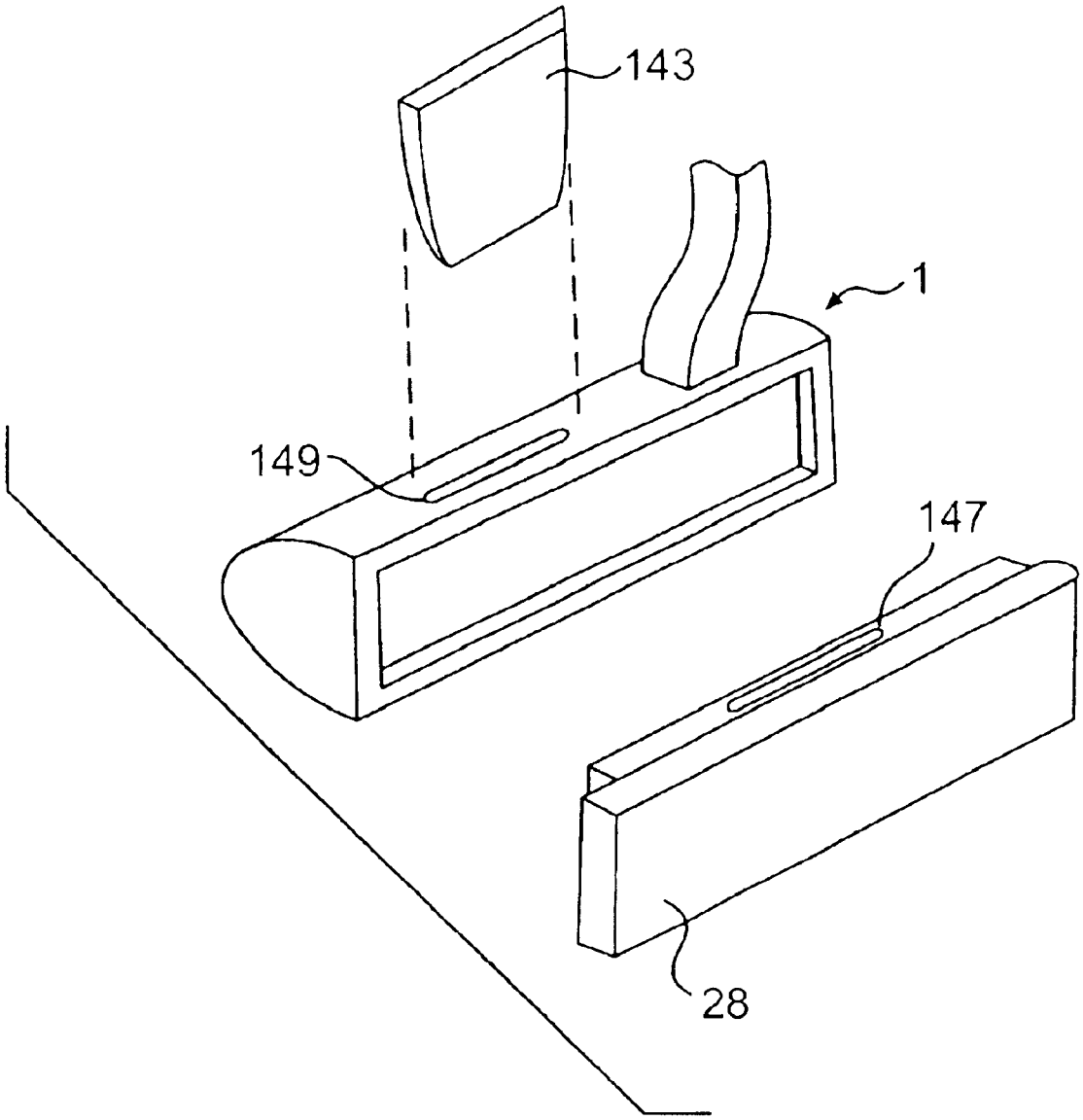
FIG. 4D is a schematic diagram of a putter head with a wedge channel for use with wedge-type locking pin lock fittings, according to a representative embodiment of the present invention.

As an alternate embodiment, the locking pins 142 of FIGS. 4A–C could be a wedge 143 as shown in FIG. 4D. Wedge 143 is inserted into a wedge channel 149 in putter head 1. Wedge channel 149 aligns with a wedge slot 147 in striking surface attachment 28. Thus, when inserted into wedge channel 149 and matching wedge channel 147 in the striking surface attachment 28, wedge 143 positively locks striking surface attachment 28 to putter head 1, without vibration or looseness. To provide this firm fit, wedge 143 is preferably made of an elastomer.

Figure 5A:
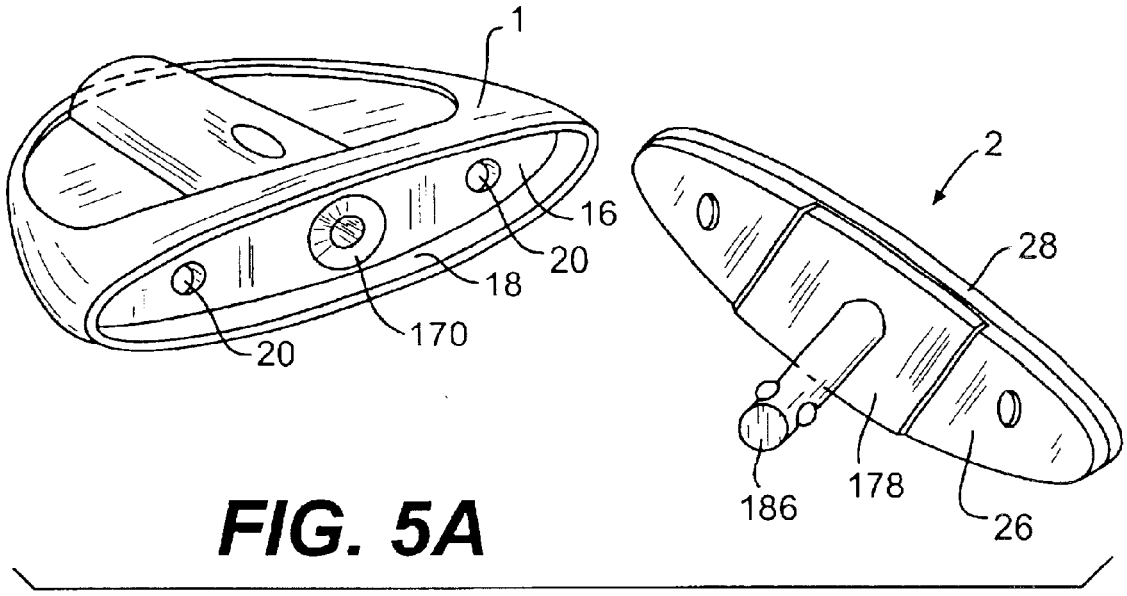
FIG. 5A is a schematic diagram of an exploded perspective view of an adjustable customized putter with a spring-loaded bearing lock fitting, according to a representative embodiment of the present invention.
Figure 5C:
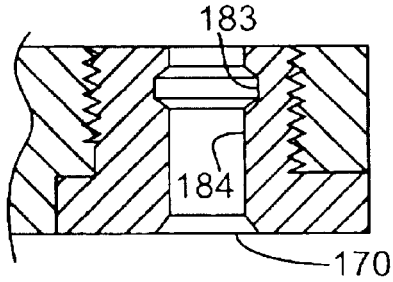
FIG. 5C is a schematic diagram of a horizontal cross section of the putter head shown in FIG. 5A along the center opening.
Figure 5B:
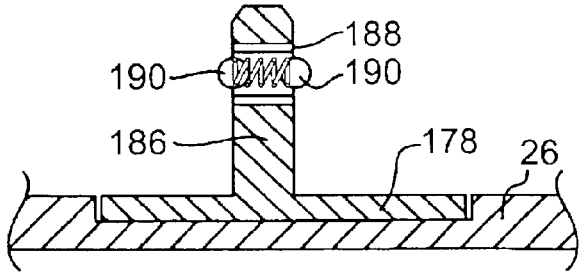
FIG. 5B is a schematic diagram of a horizontal cross section of the striking surface attachment shown in FIG. 5A along the shaft of the striking surface attachment.

Referring to FIGS. 5A–5E, a fifth preferred embodiment of the present invention uses spring-loaded bearings 190 as the one or more lock fittings 3. As shown in FIGS. 5A and 5B, a shaft component 178 is attached to striking surface attachment 2. In this case, striking surface attachment 2 is comprised of a striking surface 28 mounted on a support member 26, with shaft component 178 also attached to support member 26. Shaft component 178 has a shaft 186 with a housing 188 containing spring-loaded bearings 190.

As shown in FIGS. 5A and 5C, putter head 1 has a center opening 170 that receives shaft 186. Center opening 170 has a notched area 183 located a distance from front face 16 substantially equal to the distance between spring-loaded bearings 190 and support member 26. Thus, for quick assembly, a golfer inserts shaft 186 into center opening 170, compresses spring-loaded bearings 190 so that shaft 186 slides along cylindrical interior portion 184 of center opening 190, and pushes striking surface attachment 2 until spring-loaded bearings 190 reach notched area 183 and release. Once released, spring-loaded bearings positively lock striking surface attachment 2 against front face 16.

To quickly replace striking surface attachment 2, a golfer can grip striking surface attachment 2 and pull it away from front face 16 with a force sufficient to compress spring-loaded bearings 190. In addition, or alternatively, a golfer can insert a golf tee through passageways 20 to push striking surface attachment 2 away from front face 16.

Figure 5D:
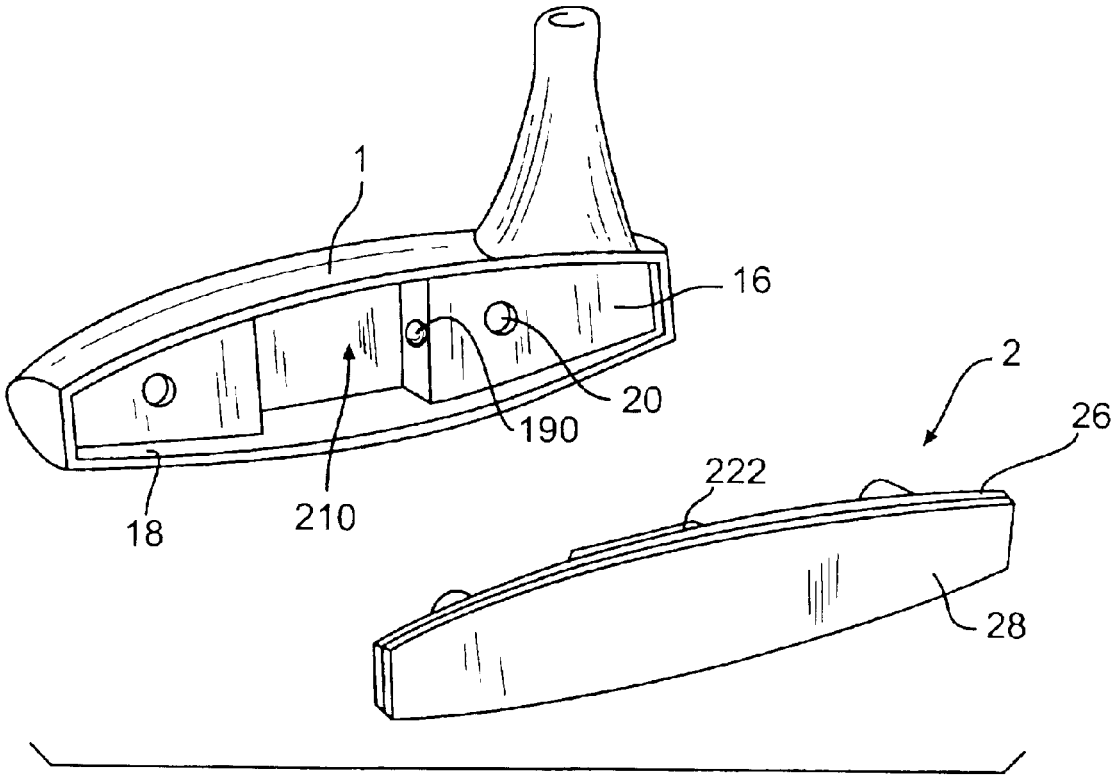
FIG. 5D is a schematic diagram of an exploded perspective view of an adjustable customized putter with a periphery rib and spring-loaded bearing lock fitting, according to a representative embodiment of the present invention.
Figure 5E:
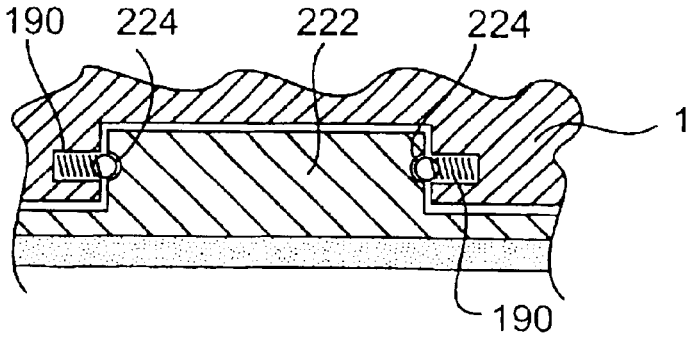
FIG. 5E is a schematic diagram of a horizontal cross section of the putter shown in FIG. 5D.

FIGS. 5D and 5E show another example of using spring-loaded bearings 190 as the one or more lock fittings 3. Cavity 18 of putter head 1 contains a recess 210 that has spring-loaded bearings 190 along its periphery. Striking surface attachment 2, which in this example comprises a striking surface 28 mounted on a support member 26, has a grooved rib 222 that is mounted on or is a part of support member 26. Grooved rib 222 is sized and shaped to fit tightly within recess 210, and has grooves 224 located a distance from the back of support member 26 substantially equal to the distance between spring-loaded bearings 190 and front face 16. Thus, to engage striking surface attachment 2, a golfer aligns grooved rib 222 with recess 210, pushes striking surface attachment to compress spring-loaded bearings 190, and slides grooved rib 222 into recess 210 until spring-loaded bearings reach grooves 224 and release. Once released, spring-loaded bearings 190 positively lock striking surface attachment 2 against front face 16.

To quickly remove striking surface attachment 2, a golfer separates striking surface attachment 2 with a force sufficient to compress spring-loaded bearings 190, either by gripping and pulling striking surface attachment 2, by inserting a golf tee into passageways 20 and pushing striking surface attachment 2, or by both of these techniques.

In addition to spring loaded bearings 190, FIGS. 5A–5E show the use of cavity 18 itself as a secondary lock fitting in the same manner as described for the first embodiment (FIGS. 1A and 1B).

Figure 6:
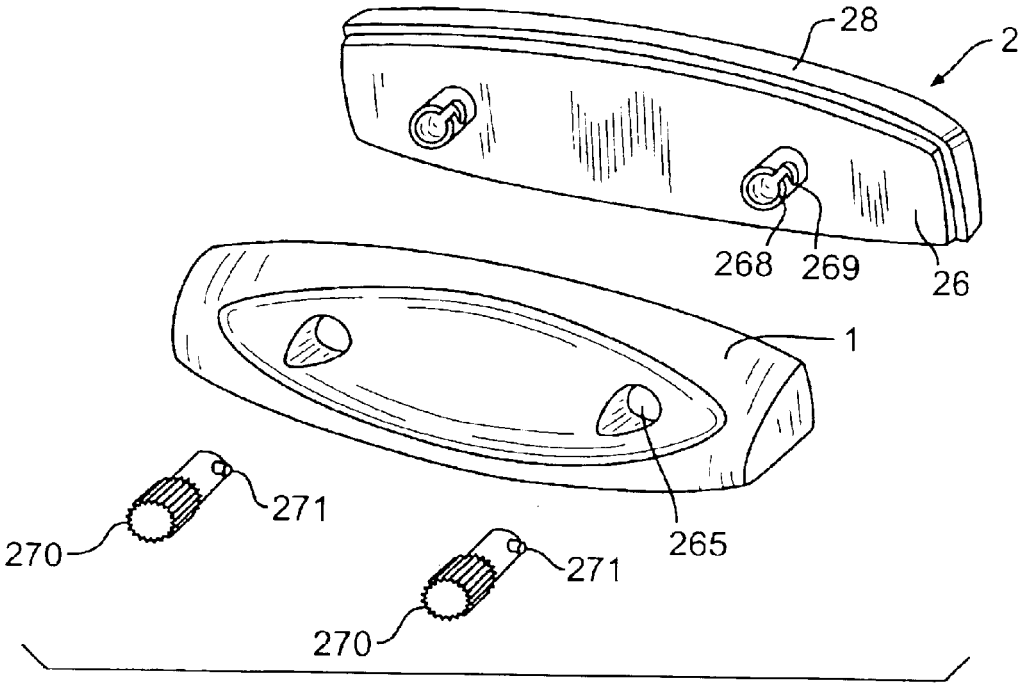
FIG. 6 is a schematic diagram of an exploded perspective view of an adjustable customized putter with a quick-turn fastener lock fitting, according to a representative embodiment of the present invention.

Referring to FIG. 6, a sixth preferred embodiment of the present invention uses quick-turn fasteners 270 as the one or more lock fittings 3. In this example, striking surface attachment 2 comprises striking surface 28 mounted on one side of support member 26, and tubes 268 mounted on the other side of support member 26. The location of tubes 268 on support member 26 matches the location of channels 265 in putter head 1 to align putter head 1 with striking surface attachment 2. Tubes 268 include slots 269 that engage knobs 271 on quick-turn fasteners 270.

Thus, for assembly, a golfer inserts tubes 268 into channels 265, inserts quick-turn fasteners 270 into tubes 268, and turns quick-turn fasteners 270 to engage knobs 271 with slots 269. Engaged to tubes 268, quick-turn fasteners 270 positively lock striking surface attachment 2 to putter head 1. For disassembly, a golfer simply turns quick-turn fasteners 270 the opposite way.

Figure 7:
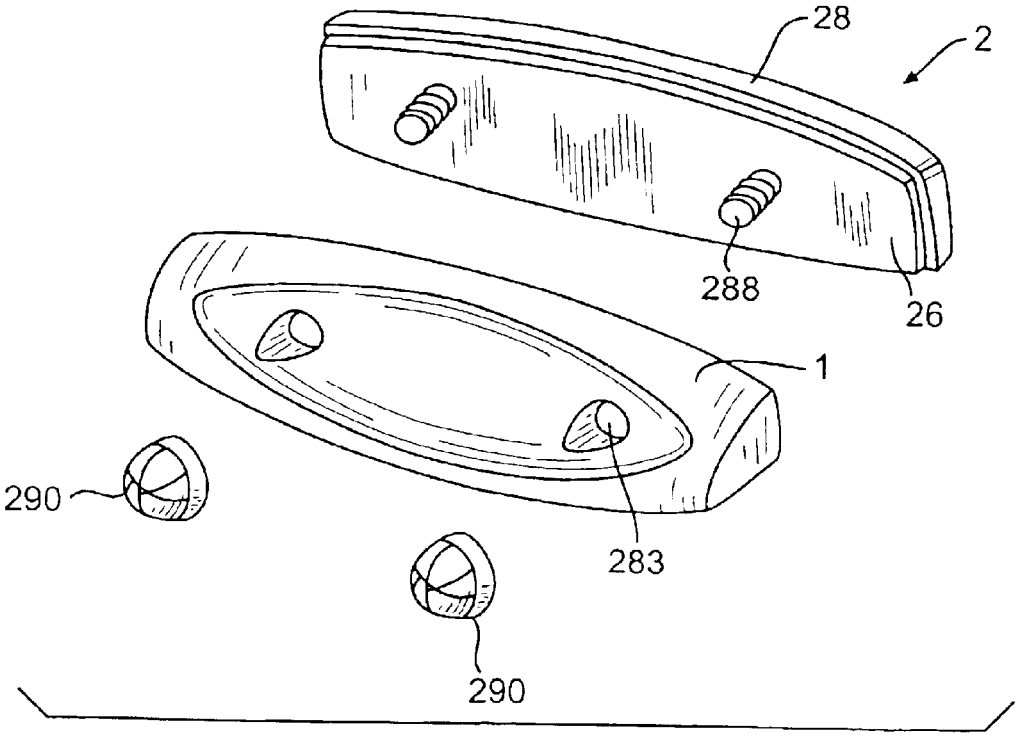
FIG. 7 is a schematic diagram of an exploded perspective view of an adjustable customized putter with a cap nut lock fitting, according to a representative embodiment of the present invention.

Referring to FIG. 7, a seventh preferred embodiment of the present invention uses cap nuts and threaded extensions as the one or more lock fittings 3. In this example, striking surface attachment 2 comprises a striking surface 28 mounted on one side of a support member 26, and threaded extensions 288 mounted on the other side of support member 26. The location of threaded extensions 288 on support member 26 matches the location of channels 283 in putter head 1 to align putter head 1 with striking surface attachment 2.

For quick assembly, a golfer inserts threaded extensions 288 into channels 283 and screws cap nuts 290 onto threaded extension 288 by hand. Cap nuts 290 tighten against the back of putter head 1, pull threaded extensions 288, and positively lock striking surface attachment 2 to putter head 1. For disassembly, a golfer simply unscrews cap nuts 290.

Figure 8:
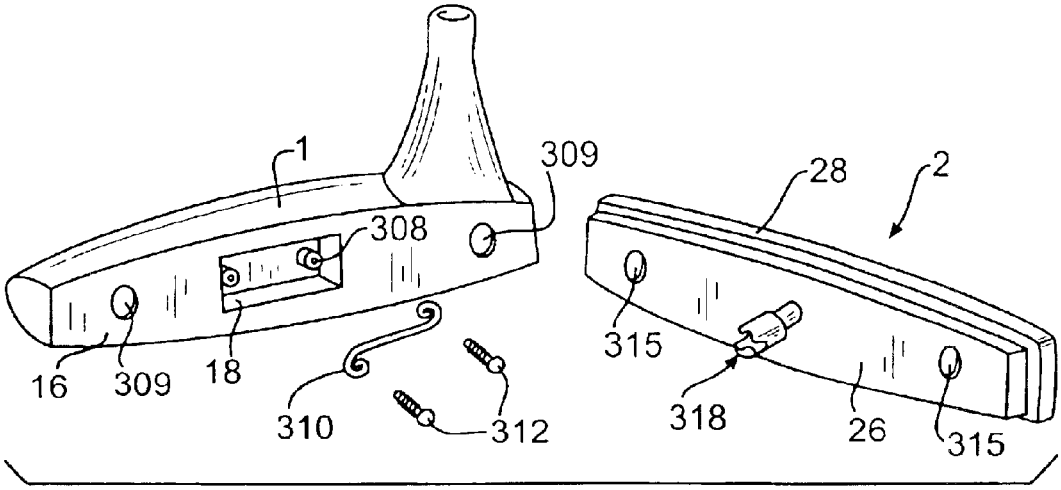
FIG. 8 is a schematic diagram of an exploded perspective view of an adjustable customized putter with a spring rod, catch-and-release lock fitting, according to a representative embodiment of the present invention.

Referring to FIG. 8, an eighth preferred embodiment of the present invention uses a spring rod 310 and catch-and-release mechanism 318 as the one or more lock fittings 3. In this example, striking surface attachment 2 comprises a striking surface 28 mounted on one side of a support member 26, and a catch-and-release mechanism 318 mounted on the other side of support member 26. Putter head 1 has a front face 16 with a cavity 18. Spring rod 310 is attached to cavity 18 by, for example, screws 312 and tapped holes 308 as is shown in FIG. 8.

To quickly assemble the components, a golfer angles striking surface attachment 2 such that the opening in catch-and-release mechanism 310 aligns with spring rod 310, and brings putter head 1 and striking surface attachment 2 together. With spring rod 310 inside catch-and-release mechanism 318, the golfer then twists striking surface attachment 2 so that catch-and-release mechanism 318 locks with spring rod 310 and striking surface attachment 2 and putter head 1 are positively locked together. When striking surface attachment 2 and putter head 1 are initially brought together, the components are not aligned; however, once striking surface attachment 2 is twisted and locked, the components fit squarely together. As an additional feature to facilitate the alignment and locking, support member 26 of striking surface attachment 2 can include protrusions 315 that snap into depressions 309 in front face 16. To quickly disengage the components, a golfer simply twists striking surface attachment 2 the opposite way with enough force to break the lock between the spring rod 310 and catch-and-release mechanism 318 and the lock between protrusions 315 and depressions 309.

Figure 9:
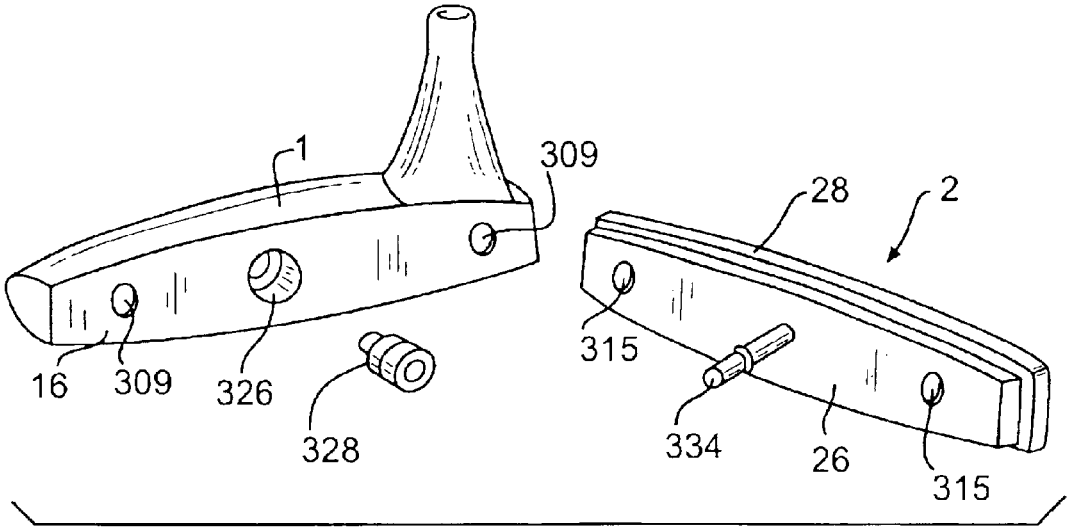
FIG. 9 is a schematic diagram of an exploded perspective view of an adjustable customized putter with a spring-loaded catch-and-release lock fitting, according to a representative embodiment of the present invention.

Referring to FIG. 9, a ninth preferred embodiment of the present invention uses a spring-loaded catch-and-release mechanism 328 as the one or more lock fittings 3. In this example, striking surface attachment 2 comprises a striking surface 28 mounted on one side of a support member 26, and a rod 334 mounted on the other side of support member 26. To align putter head 1 with striking surface attachment 2, the location of rod 334 on support member 26 matches the location of spring-loaded catch-and-release mechanism 328 housed in cavity 326 of putter head 1.

To quickly assemble the components, a golfer angles striking surface attachment 2 such that rod 334 can move freely through spring-loaded catch-and-release mechanism 328, and then pushes rod 334 into spring-loaded catch-and-release mechanism 328 until the back of support member 26 rests against front face 16. Then, the golfer twists striking surface attachment 2 so that rod 334 locks onto spring-loaded catch-and-release mechanism 328 and positively locks striking surface attachment 2 to putter head 1 in a tight, aligned fit. When striking surface attachment 2 and putter head 1 are initially brought together, the components are not aligned; however, once striking surface attachment 2 is twisted and locked, the components fit squarely together. As with the previous embodiment, to aid alignment and locking, support member 26 of striking surface attachment 2 can include protrusions 315 that snap into depressions 309 in front face 16. To quickly disengage the components, a golfer simply twists striking surface attachment 2 the opposite way to a position at which rod 334 is freed from spring-loaded catch-and-release mechanism and with enough force to break the lock between rod 334 and spring-loaded catch-and-release mechanism 328 and the lock between protrusions 315 and depressions 309.

Figure 10A:
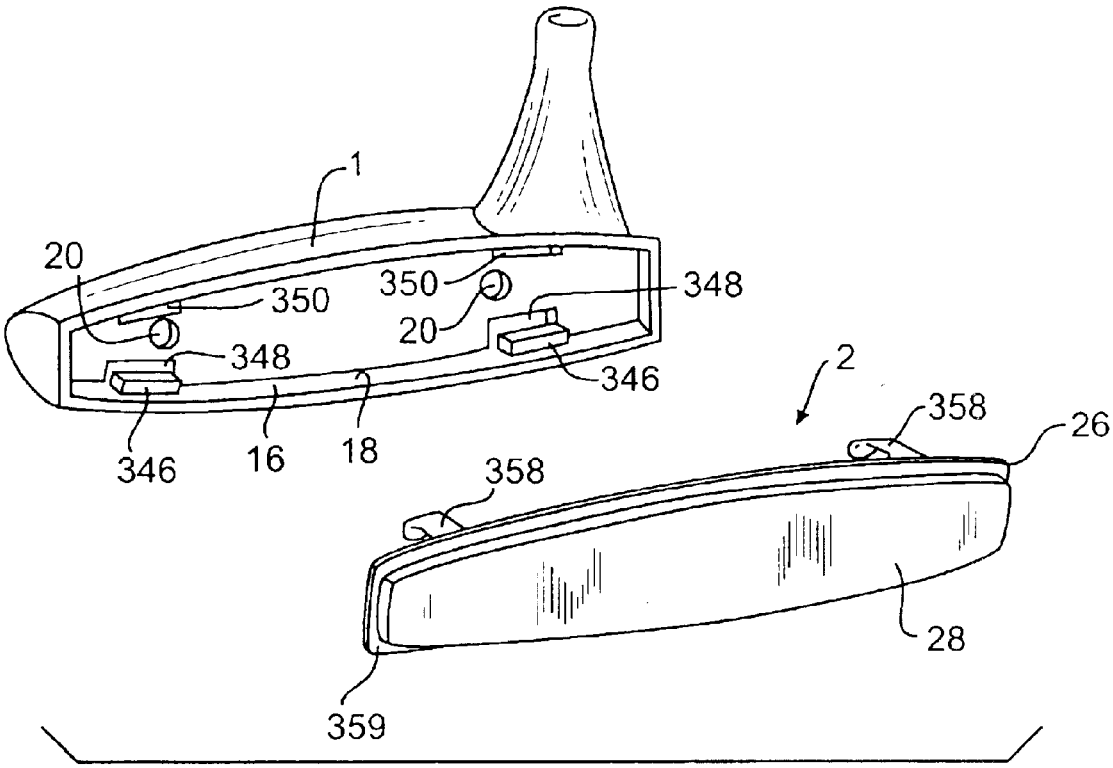
FIG. 10A is a schematic diagram of an exploded perspective view of an adjustable customized putter with a spring clip lock fitting, according to a representative embodiment of the present invention.
Figure 10B:
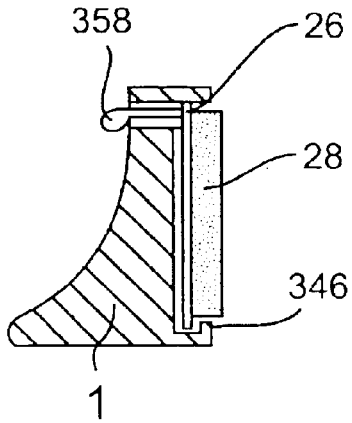
FIG. 10B is a schematic diagram of a vertical cross section of the putter shown in FIG. 10A.

Referring to FIGS. 10A and 10B, a tenth preferred embodiment of the present invention uses spring clips 358 as the one or more lock fittings 3. In this example, striking surface attachment 2 comprises a striking surface 28 mounted on one side of a support member 26, spring clips 358 mounted on the other side of support member 26, and a lip 359 mounted on the periphery of support member 26. Putter head 1 has a front face 16 with a cavity 18, which has tabs 346, lip openings 348, passageways 20, and slots 350. Tabs 346 and lip openings 348 are provisioned on the edge of cavity 18 to receive lip 359 of striking surface attachment 2. The location of slots 350 matches the location of spring clips 358 to provide an aligned fit between striking surface attachment 2 and putter head 1.

To quickly join the components, a golfer first tilts striking surface attachment 2 with striking surface 28 facing down and inserts lip 359 into lip opening 348 and behind tabs 346. The golfer then pivots the top of striking surface attachment 2 toward putter head 1 such that spring clips 358 enter slots 350. Spring clips 358 compress while passing through slots 350, and once they reach an open area, e.g., the back of putter head 1 as shown in FIG. 10B, they release and positively lock striking surface attachment 28 to front face 16. Having tabs 346 restrain lip 359 further enhances this positive locking.

A golfer has several options for quickly disassembling the components. The golfer can simply grip striking surface attachment 2 and pull it with a force sufficient to compress spring clips 358. Or, the golfer can push on spring clips 358 from behind putter head 1 with the same amount of force. Or, the golfer can insert golf tees into passageways 20 to apply the same force.

Figure 11:
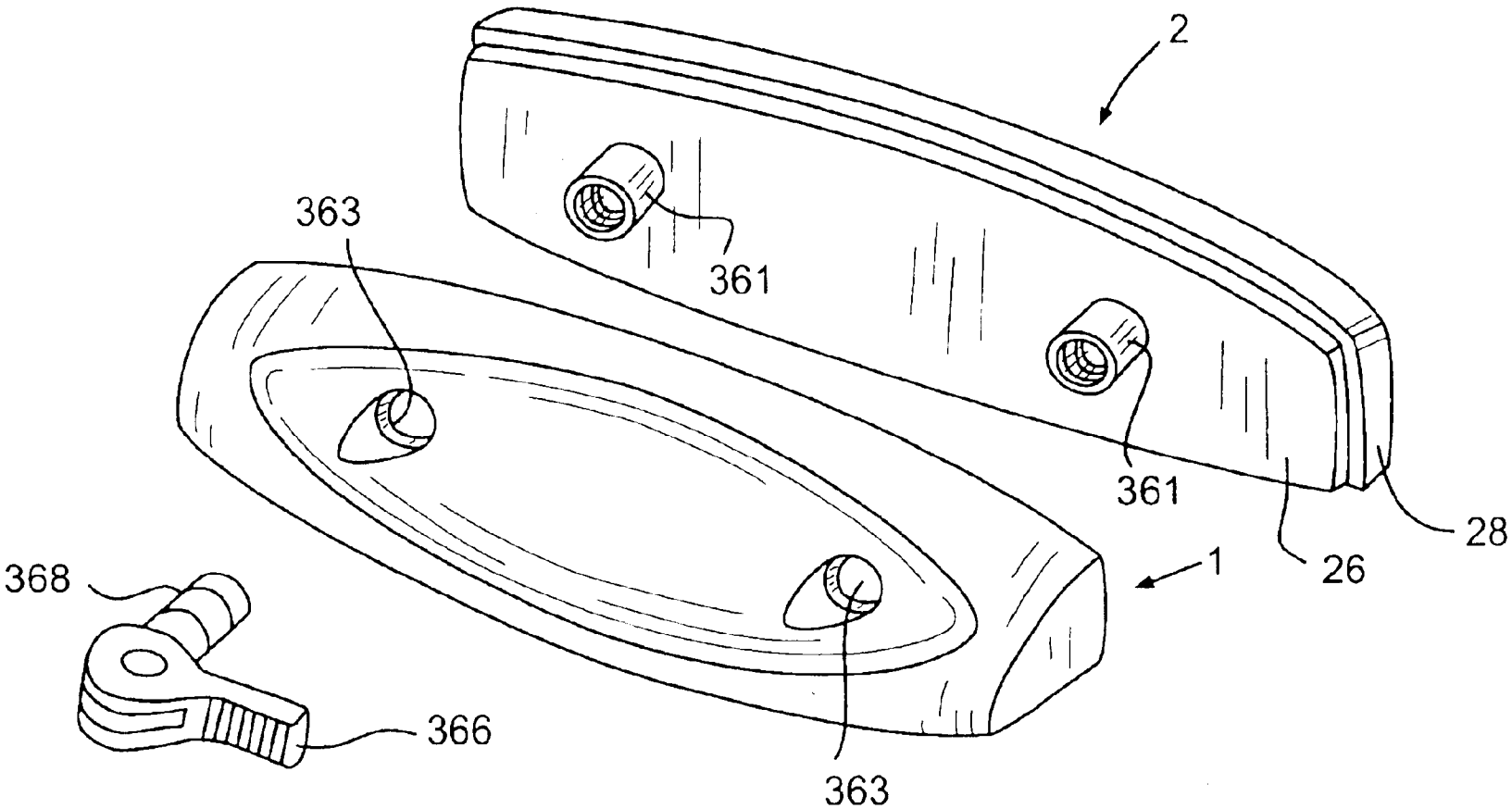
FIG. 11 is a schematic diagram of an exploded perspective view of an adjustable customized putter with a swell fastener lock fitting, according to a representative embodiment of the present invention.

Referring to FIG. 11, an eleventh preferred embodiment of the present invention uses swell fasteners 368 as the one or more lock fittings 3. In this embodiment, striking surface attachment 2 comprises a striking surface 28 mounted on one side of a support member 26 and grooved tubes 361 mounted on the other side of support member 26. The location of grooved tubes 361 on support member 26 matches the location of channels 363 in putter head 1 to align putter head 1 with striking surface attachment 2. Swell fasteners 368 have key portions 366 that operate and lock swell fasteners 368.

To quickly join the components, a golfer inserts grooved tubes 361 into channels 363 until support member 26 rests against putter head 1. The golfer then inserts swell fasteners 368 into grooved tubes 361 and actuates the key portions 366 to enlarge swell fasteners 368 within grooved tubes 361. Once fully actuated, swell fasteners 368 positively lock putter head 1 with striking surface attachment 2. To quickly disengage the components, a golfer simply actuates the key portions 366 in the opposite direction, reduces the size of swell fasteners 368, and removes swell fasteners 368 from grooved tubes 361.

Figure 12A:
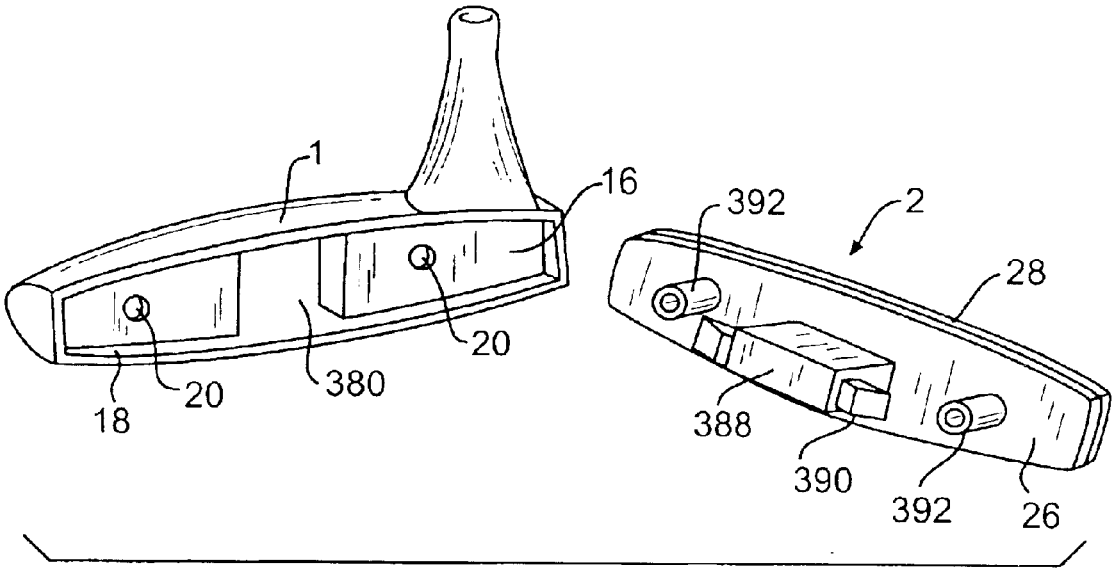
FIG. 12A is a schematic of an exploded perspective view of an adjustable customized putter with a spring latch lock fitting, according to a representative embodiment of the present invention.
Figure 12B:
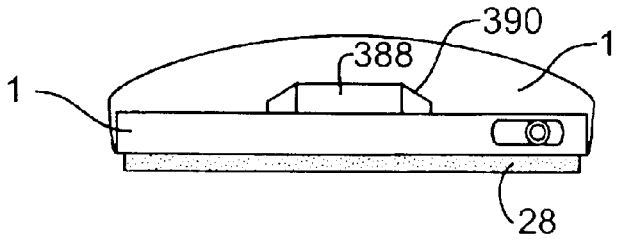
FIG. 12B is a schematic diagram of a horizontal cross section of the putter shown in FIG. 12A.

Referring to FIGS. 12A and 12B, a twelfth preferred embodiment of the present invention uses spring latches 390 as the one or more lock fittings 3. In this embodiment, striking surface attachment 2 comprises a striking surface 28 mounted on one side of a support member 26, and a spring latch projection 388 having spring latches 390 mounted on the other side of support member 26. Front face 16 of putter head 1 has a cavity 18 and a spring latch opening 380 that penetrates the width of putter head 1, or alternatively, penetrates a portion of putter head 1 to a hollow space within putter head 1. For alignment and locking, alternatively, support member 26 has protrusions 392 located to match passageways 20 in putter head 1.

For quick assembly, a golfer inserts spring latch projection 388 into spring latch opening 380 with a force sufficient to push spring latches 390 down into spring latch projection 388. Once spring latch projection reaches the other side of spring latch opening 380 and support member 26 rests against front face 16, spring latches 390 release and slide against the back of putter head 1, as shown in FIG. 12B. Released, spring latches 390 positively lock striking surface attachment against putter head 1. To quickly disengage the components, a golfer squeezes spring latches 390 so that spring latch projection 388 can slide out of spring latch opening 380.

Figure 13:
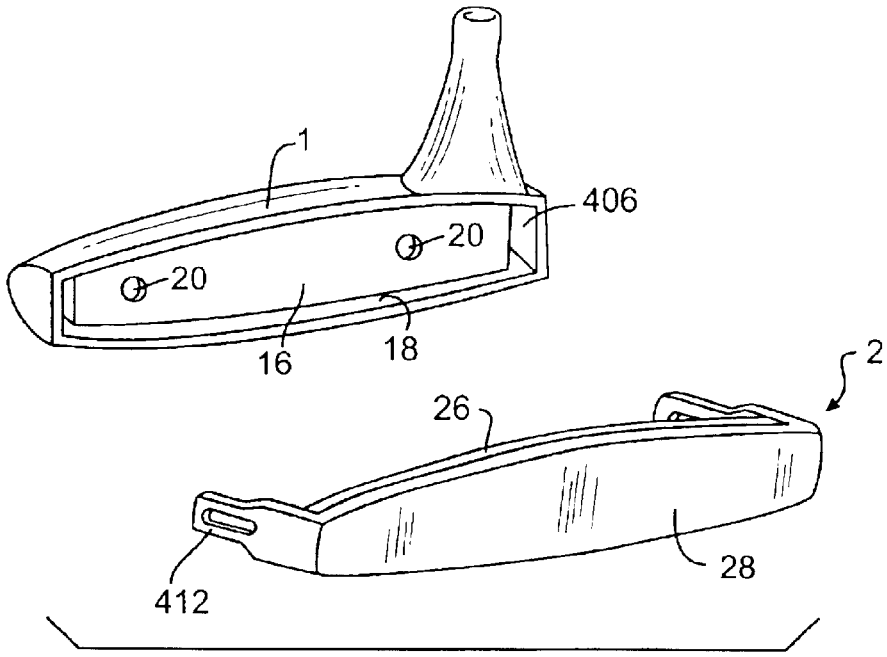
FIG. 13 is a schematic diagram of an exploded perspective view of an adjustable customized putter with a flexible strap lock fitting, according to a representative embodiment of the present invention.

Referring to FIG. 13, a thirteenth preferred embodiment of the present invention uses flexible straps 412 as the one or more lock fittings 3. Striking surface attachment 2, which in this embodiment comprises a striking surface 28 mounted on a support member 26, includes flexible straps 412 mounted either on support member 26 or striking surface 28. In turn, front face 16 of putter head 1 has a cavity 18 with strap slots 406 extending to the back of putter head 1. The back of putter head 1 has a post (not shown) proximate to each strap slot 406. For alignment and locking, alternatively, support member 26 has protrusions (not shown) located to match passageways 20 in putter head 1.

Flexible straps 412 have openings at their ends and are constructed of any stretchable material that retains its original shape, e.g., an elastomeric material. As such, for quick assembly, a golfer inserts flexible straps 412 into strap slots 406 through to the back of putter head 1. The golfer then pulls and stretches flexible straps 412 over the posts and hooks the opening of flexible straps 412. The force of the flexible straps 412 pulling against the posts positively locks striking surface attachment 2 to putter head 1. For quick disassembly, the golfer stretches flexible straps 412 up and over the posts, and pulls (or pushes with a golf tee through passageways 20) striking surface attachment 2 away from putter head 1.

In addition to the lock fitting provided by flexible straps 412, FIG. 13 shows the use of cavity 18 itself as a secondary lock fitting in the same manner as described for the first embodiment (FIGS. 1A and 1B).

Figure 14:
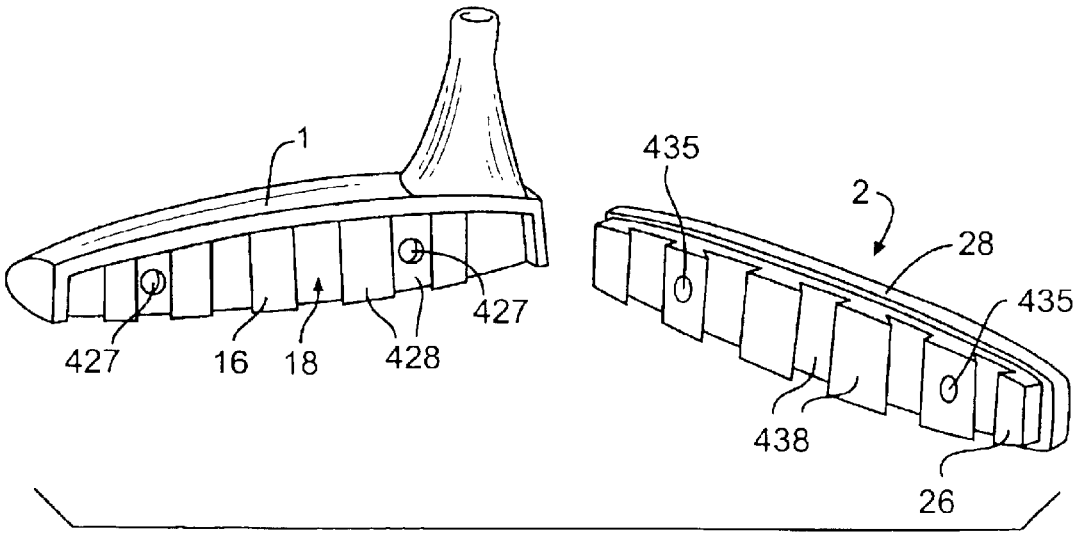
FIG. 14 is a schematic diagram of an exploded perspective view of an adjustable customized putter with a dovetail slot lock fitting, according to a representative embodiment of the present invention.

Referring to FIG. 14, a fourteenth preferred embodiment of the present invention uses dovetail slots 428 as the one or more lock fittings 3. In this embodiment, striking surface attachment 2 comprises a striking surface 28 mounted on a support member 26 with integral dovetail slots 438. Putter head 1 comprises a front face 16 with a cavity 18 with integral opposite dovetail slots 428 to receive dovetail slots 438.

For quick assembly, a golfer aligns dovetail slots 438 with opposite dovetail slots 428 and slides striking surface attachment 2 into cavity 18 of putter head 1. Preferably, dovetail slots 438 and opposite dovetail slots 428 are formed by injection molding to promote minimal tolerances and a tight fit. As such, when dovetail slots 438 are fully engaged with opposite dovetail slots 428, the striking surface attachment 1 is positively locked to putter head 1. For quick disassembly, a golfer must push striking surface attachment 2 in the opposite direction with enough force to break the positive lock provided by the tight fit of the dovetail slots. Although FIG. 14 illustrates vertical dovetail slots, this embodiment may include dovetail slots of varying orientation, e.g., horizontal dovetail slots.

In addition to the lock fitting provided by dovetail slots 438 and opposite dovetail slots 428, FIG. 14 shows the use of channels 427 and openings 435 as a secondary lock fitting, e.g., using locking pins or swell fasteners.

Referring to FIGS. 15A–15E, a fifteenth preferred embodiment of the present invention uses lap joints as the one or more lock fittings 3. In this embodiment, striking surface attachment 2 comprises a striking surface 28 mounted on an irregularly shaped support member 26, e.g., "L" shaped. Support member 26 can be of any shape that creates a void 454 between support member 26 and striking surface 28, into which a matching part of putter head 1 can be tightly inserted. To create this fit, putter head 1 has a cavity 18 with a second cavity 446, between the two of which is a lap piece 464.

For quick assembly, a golfer slides striking surface attachment 2 into cavity 18 of putter head 1 such that lap piece 464 occupies void 454. Preferably, putter head 1 and striking surface attachment 2 are constructed of similar or complementary materials that promote minimal tolerances and tight fit. As such, when lap piece 464 is fully engaged in void 454, striking surface attachment 1 is positively locked to putter head 1 by an interference fit of the walls of the lap joint. For disassembly, a golfer must push striking surface attachment 2 in the opposite direction with enough force to break the positive lock provided by the tight fit of the lap joint.

Figure 15A:
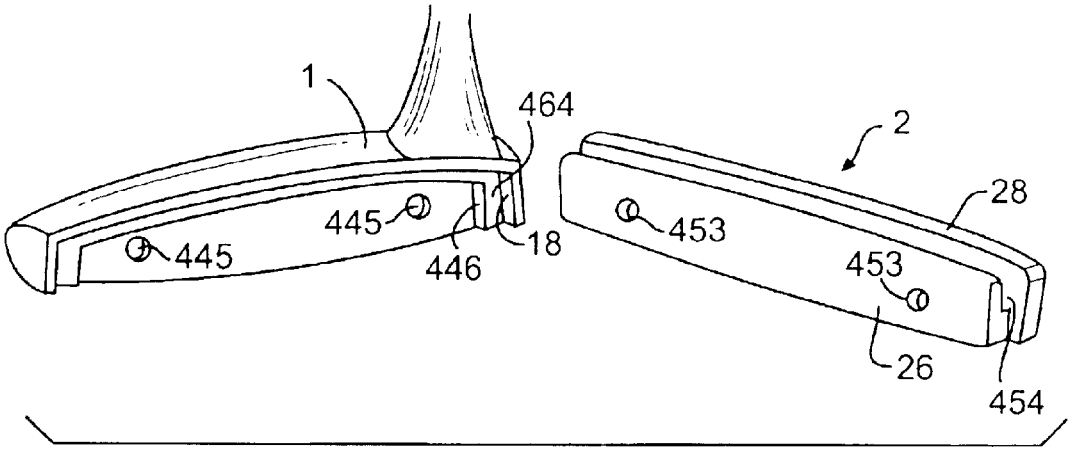
FIG. 15A is a schematic diagram of an exploded perspective view of an adjustable customized putter with a lap joint lock fitting, according to a representative embodiment of the present invention.
Figure 15B:
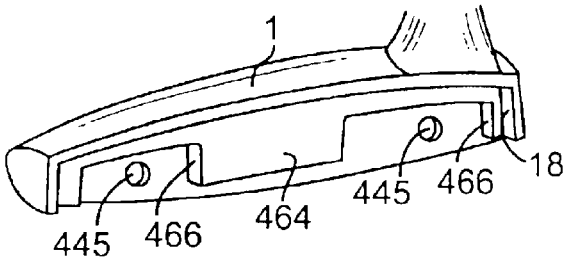
FIGS. 15B–15D are schematic diagrams of various putter heads used with lap joint lock fittings, according to a representative embodiment of the present invention.
Figure 15C:
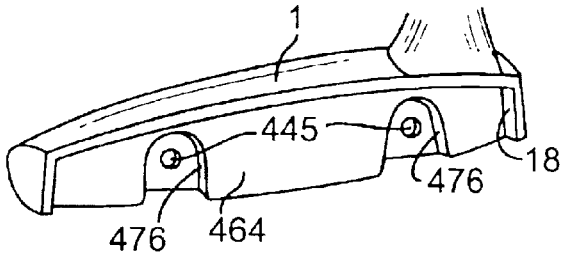
Figure 15D:
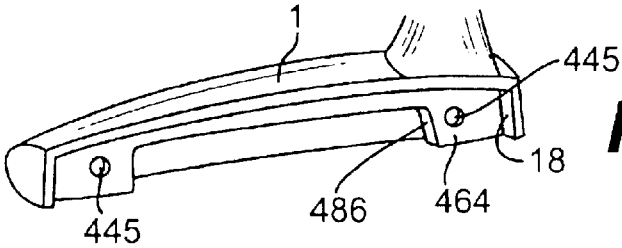
Figure 15E:
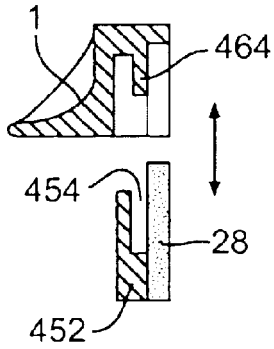
FIG. 15E is a schematic diagram of an exploded vertical cross sectional view of the striking surface attachment of FIG. 15A engaging the putter head of FIG. 15B.

To promote the positive locking of the lap joint, lap piece 464 can be formed in a variety of shapes, which aim to increase contacting surface area. In FIG. 16A, lap piece 464 is an apron around cavity 18. In FIG. 15B, lap piece 464 has two rectangular openings 466. In FIG. 15C, lap piece 464 has semi-circular openings 476. In FIG. 15D, lap piece 464 has one rectangular opening 486.

In addition to the lock fitting provided by the lap joint, FIGS. 15A–15E show the use of channels 445 and openings 453 as a secondary lock fitting, e.g., using locking pins, swell fasteners, or screws. The various shapes of lap piece 464 incorporate this secondary lock fitting at various locations.

As an alternate feature for each of the above-described preferred embodiments, as shown in FIGS. 16A–16F, support member 26 of striking surface attachment 2 may include various rib configurations that redistribute the weight of the putter and modify the location of the sweet spot. (Although FIGS. 16A–16F illustrate rib configurations with the embodiment using press-fit adaptors 66, the rib feature applies equally as well to other embodiments.) As shown in FIGS. 16A and 16B, the rib configuration may comprise a large oval-shaped rib 92 provided near the center of support member 26, or a small oval-shaped rib 96 provided in the same location of support member 26. FIG. 16C shows a rib configuration 97 that begins small at the center of support member 26, and grows as it extends along the length of support member 26. FIG. 16D shows a rectangular rib 102 that is located adjacent to the center of support member 26. FIGS. 16E and 16F show an I-shaped rib 109 located near the center of support member 26 with a metal weight 105 provisioned between striking surface 28 and I-shaped rib 109 to alter the sweet spot of the putter head.

Each of the above embodiments uses one or more lock fittings to positively lock and firmly fix the putter components together. The present invention therefore provides a critical fit within a range between an ineffective fit that is loose and a tight fit that is burdensome to interchange, i.e., is not quickly interchangeable. However, because the rules and rules decisions of golf governing bodies (e.g., USGA, Professional Golfers' Association (PGA), and The Royal & Ancient Golf Club of St. Andrews) can be inconsistent and subject to frequent change, the present invention allows for the use of fasteners that require tools as an additional securing means for releasably securing a striking surface attachment to a putter head. Specifically, if a particular interpretation of a rule were to require a fastener that requires tools, e.g., a screw, the present invention adds this fastener in addition to the one or more lock fittings.

For example, the additional securing means could include at least one passageway in the putter head aligned with at least one opening in the striking surface attachment, and at least one elongate connecting member, e.g., a screw, positioned within the passageway and opening, and holding the components together. In this manner, the one or more lock fittings still provide the positive locking, making the additional fastener a feature necessary solely to comply with official rules, but not to achieve a component fit comparable to that of a fixed-face putter. A golfer could still quickly replace striking surface attachments to find a desired feel by using only the one or more lock fittings, but when necessary to conform to rules prohibiting readily changeable parts, the golfer would simply add a screw or some other fastener to the putter.

Various methods of removing the attachments of the present invention have been shown by way of example. These methods are intended to be purely exemplary of the invention, and other methods of manually disengaging the attachments may be employed.

In addition, although the preferred embodiments of the present invention describe specific component configurations, one of ordinary skill in the art would understand that combinations and modifications to these configurations are possible. For instance, although a hosel is shown as a component of the golf putter of the present invention in some embodiments, it should be understood that a hosel is not necessary to accomplish the objects of the present invention. Indeed, FIG. 5A illustrates such a situation, in which the putter head does not have a hosel. Further, although some embodiments of the present invention incorporate more than one lock fitting, it should be understood that for each embodiment, the method of attaching the striking surface attachment could employ one or more lock fittings. In addition, although some embodiments describe the striking surface attachment as having the separate components of a striking surface and a support member, these components could be integrated into a single piece such that the striking surface attachment is a single component.

As apparent to those skilled in the art, various modifications and variations can be made in the manually replaceable striking surface attachments of the present invention and in the construction of these attachments without departing from the scope or spirit of the invention. As an example, striking surfaces may be made from numerous types of materials, including but not limited to rubber, plastics, elastomers, non-elastomers, titanium, aluminum, and copper, as well as other metals usable in the golf club art.

In addition to changing striking surface properties with different materials, the loft of the golf putter can be adjusted in various manners. Golfers typically prefer a putter loft anywhere from zero to eight degrees. Changing loft can be accomplished by varying the angle of the front of the striking surface, or by varying the straightness of the back side of the striking surface so that when the striking surface attachment is coupled to the putter head, a certain degree of loft can be achieved.

In practicing the present invention, the striking surface of the striking surface attachment may include either an elastomeric or non-elastomeric material, depending upon the golfer's preference. Preferred elastomeric striking surfaces include any of the elastomers defined in U.S. Pat. No. 4,422,638, assigned to the assignee of the present application and incorporated herein by reference in its entirety. Preferably the elastomeric striking surface has the controlled properties defined in the '638 patent. However, according to the present invention, since the striking surface of the putter is quickly changed, the elastomeric striking surface can be suitably chosen to meet the playing characteristics desired by the individual golfer, with those characteristics being changed simply by selecting an elastomer having different touch, feel, hardness, and rebound characteristics.

As apparent to one skilled in the art, various polymers, including polymers having different chemical formulations, can be fabricated to meet the hardness and rebound characteristics essential to provide an elastomeric striking surface in accordance with the present invention. Polyester elastomers marketed by DuPont under the trade name HYTREL are presently preferred materials. HYTREL 8122, which provides a fast or high rebound, and HYTREL 4069, which provides a slow or low rebound, are illustrative of such elastomers. Moreover, the thickness of the elastomeric surface can vary. Although it has been found that a thickness of three-sixteenths (3/16") inch is acceptable, the thickness can be increased or decreased. "Elastomer" as used herein is intended to designate any synthetic plastic material that provides the rebound characteristics useful in a putter face.

The characteristics of the putter can also be modified by judicious selection of the material for the putter head. Thus, preferably the putter head comprises metal such as stainless steel or brass, but again can be of a different metal, or plastic, to provide varying characteristics in the putter.

In addition to customizing the putter by selecting specific materials for the putter head, striking surface, and the striking surface attachment, a further preferred embodiment of the present invention uses the same or similar process to make each of these components. Using materials that are all injection molded (rather than using some injection molded components and some cast components) achieves a tighter fit between the components, and avoids dimensional variances due to such factors as dissimilar coefficients of thermal expansion and inconsistent manufacturing tolerances. As an example of this embodiment, both the putter head and striking surface attachment can be made of a thermoplastic material such that the striking surface attachment fits securely in the putter head without looseness. With accurate alignment and fit, this positive locking of the striking surface attachment could serve as either the primary, secondary, or sole lock fitting for attaching the striking surface attachment to the putter head. In addition to a thermoplastic material, composites are an example of other suitable materials.

Although this specification illustrates the present invention using the representative embodiment of a golf putter, one of ordinary skill in the art would appreciate that the structures, functions, and methods described herein apply equally well to other types of golf clubs. Indeed, the head, the striking surface attachment, and the one or more lock fittings of the present invention could be components of clubs such as wedges, drivers, fairway woods, and irons. Moreover, the present invention provides these other types of clubs with most, if not all, of the same benefits described above in the context of a golf putter.

Other embodiments of the invention will be apparent to those skilled in the art from consideration of the specification and practice of the invention disclosed herein. It is intended that the specification and examples be considered as exemplary only, with a true scope and spirit of the invention being indicated by the claims.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims, and by their equivalents.

What is claimed is:

1. A golf putter comprising:

a putter head defining a cavity, the cavity having a surface that is one of metallic and magnetic;

a striking surface attachment disposed in the cavity of the putter head, wherein the striking surface attachment is made of a flexible elastomer; and a flexible magnetic sheet attached to the striking surface attachment, wherein the flexible magnetic sheet bonds to the surface of the cavity of the putter head.

2. The golf putter of claim 1, wherein the surface of the putter head cavity comprises a second flexible magnetic sheet.

3. The golf putter of claim 1, further comprising a magnet disposed in the surface of the putter head cavity.

4. The golf putter of claim 1, wherein the putter head comprises a metal core and a thermoplastic shell molded around the metal core.

5. The golf putter of claim 4, wherein the surface of the cavity of the putter head to which the flexible magnetic sheet is bonded is a portion of the metal core exposed in the cavity.

6. The golf putter of claim 1, wherein the striking surface attachment includes one of a tab, ridge, flange, and indentation for gripping and separating the striking surface attachment from the putter head.

7. The golf putter of claim 1, wherein the putter head includes an indentation proximate to the cavity for gripping and separating the striking surface attachment from the putter head.

8. The golf putter of claim 1, wherein the putter head defines a groove in the cavity's periphery and the striking surface attachment has a flexible rib on its outer periphery, and wherein the flexible rib is disposed within the groove.

9. The golf putter of claim 8, wherein the outer periphery of the striking surface attachment, including the flexible rib, is larger than the periphery of the cavity such that the flexible rib must deform for the striking surface attachment to pass into the cavity.

10. The golf putter of claim 1, wherein the striking surface attachment has a flexible strap, wherein the putter head has a post, and wherein the flexible strap is retained by the post.

11. The golf putter of claim 10, wherein the putter head defines an opening through which the flexible strap is routed from the surface of the cavity to the post.

12. The golf putter of claim 10, wherein the flexible strap defines an opening in which the post is disposed.

* * * * *